US009266010B2

(12) United States Patent
Kloster et al.

(10) Patent No.: US 9,266,010 B2
(45) Date of Patent: Feb. 23, 2016

(54) SPLITBOARD BINDING WITH ADJUSTABLE LEVERAGE DEVICES

(71) Applicants: Tyler G. Kloster, Snoqualmie, WA (US); Bryce M. Kloster, Seattle, WA (US)

(72) Inventors: Tyler G. Kloster, Snoqualmie, WA (US); Bryce M. Kloster, Seattle, WA (US)

( * ) Notice: Subject to any disclaimer, the term of this patent is extended or adjusted under 35 U.S.C. 154(b) by 144 days.

(21) Appl. No.: 13/915,370

(22) Filed: Jun. 11, 2013

(65) Prior Publication Data

US 2014/0167392 A1 Jun. 19, 2014

Related U.S. Application Data

(60) Provisional application No. 61/658,849, filed on Jun. 12, 2012.

(51) Int. Cl.

| | |
|---|---|
| ***A63C 10/02*** | (2012.01) |
| ***A63C 10/04*** | (2012.01) |
| ***A63C 10/06*** | (2012.01) |
| ***A63C 10/14*** | (2012.01) |
| ***A63C 10/24*** | (2012.01) |
| *A63C 5/02* | (2006.01) |
| *A63C 5/03* | (2006.01) |

(52) U.S. Cl.

CPC ..... *A63C 10/02* (2013.01); *A63C 10/04* (2013.01); *A63C 10/06* (2013.01); *A63C 10/145* (2013.01); *A63C 10/24* (2013.01); *A63C 5/02* (2013.01); *A63C 5/031* (2013.01)

(58) Field of Classification Search

CPC ..... A43B 7/20; A43B 5/0401

See application file for complete search history.

(56) References Cited

U.S. PATENT DOCUMENTS

| | | | | |
|---|---|---|---|---|
| 31,259 | A * | 1/1861 | Rich | A63C 10/04 280/11.36 |
| 1,473,011 | A | 11/1923 | Christophel | |
| 1,477,692 | A | 12/1923 | Christophel | |

(Continued)

FOREIGN PATENT DOCUMENTS

| | | |
|---|---|---|
| CH | 681 509 A5 | 4/1993 |
| DE | 89 03154.7 | 3/1989 |

(Continued)

OTHER PUBLICATIONS

Brochure for NITRO USA Snowboards, dated 1993-1994.

(Continued)

*Primary Examiner* — Brodie Follman

(74) *Attorney, Agent, or Firm* — Knobbe, Martens, Olson & Bear, LLP

(57) ABSTRACT

Some embodiments disclosed herein provide systems, methods, and apparatus relating to a touring snowboard binding comprising an adjustable lateral leverage device. In some embodiments, the adjustable lateral leverage device may comprise at least one first attachment generally at a top corner of a highback of a touring snowboard boot and at least one second attachment generally at an ankle portion of the binding. The adjustable tensioning element may extend generally diagonally between the at least one first attachment and the at least one second attachment such that when the tension in the adjustable lateral leverage device is increased the lateral support to the boot is increased proportionally and when the tension in the adjustable lateral leverage device is decreased the lateral support to the boot is decreased proportionally. Some embodiments also provide a touring snowboard boot comprising an adjustable leverage device.

9 Claims, 16 Drawing Sheets

(56) References Cited

U.S. PATENT DOCUMENTS 2,660,812 A * 12/1953 Henke ..... A43C 5/0486 36/1.5
3,061,325 A 10/1962 Glass
3,171,667 A 3/1965 Wightman
3,439,928 A 4/1969 Noguchi
3,506,279 A 4/1970 Lambert
3,593,356 A 7/1971 Schmalfeldt
3,627,349 A 12/1971 Barry
3,677,566 A 7/1972 Lawrence
3,782,745 A 1/1974 Stoveken
3,861,698 A 1/1975 Greig
4,022,491 A 5/1977 Powell
4,062,553 A 12/1977 Riedel
4,085,528 A * 4/1978 Delery ..... A43D 999/00 36/118.8
4,138,128 A 2/1979 Criss
4,163,565 A 8/1979 Weber
4,190,970 A * 3/1980 Annovi ..... A43B 5/0449 24/70 SK
4,221,394 A 9/1980 Campbell
4,275,904 A 6/1981 Pedersen
4,403,785 A 9/1983 Hottel
4,428,608 A 1/1984 Cooke et al.
4,473,235 A * 9/1984 Burt ..... A63C 5/06 280/11.36
4,547,981 A * 10/1985 Thais ..... A43B 7/00 36/114
4,652,007 A 3/1987 Dennis
4,700,967 A 10/1987 Meatto et al.
4,705,308 A 11/1987 Bisbing
4,728,116 A 3/1988 Hill
4,741,550 A 5/1988 Dennis
4,770,441 A 9/1988 Demonsant et al.
4,817,988 A 4/1989 Chauvet et al.
4,856,808 A 8/1989 Longoni
4,871,337 A 10/1989 Harris
4,949,479 A * 8/1990 Ottieri ..... A43B 5/0435 36/117.1
4,951,960 A 8/1990 Sadler
4,955,632 A 9/1990 Giarritta et al.
4,973,073 A 11/1990 Raines et al.
4,979,760 A * 12/1990 Derrah ..... A63C 10/24 280/11.36
4,982,733 A * 1/1991 Broadhurst ..... A61F 5/0111 602/27
5,028,068 A 7/1991 Donovan
5,035,443 A 7/1991 Kincheloe
5,044,654 A 9/1991 Meyer
5,065,530 A * 11/1991 Pozzobon ..... A43C 11/16 24/68 SK
5,065,533 A * 11/1991 Paris ..... A43B 5/048 36/118.1
5,069,463 A 12/1991 Baud et al.
5,109,616 A 5/1992 Lush
5,145,202 A 9/1992 Miller
5,156,644 A 10/1992 Koehler et al.
5,249,816 A 10/1993 Southworth
5,299,823 A 4/1994 Glaser
5,344,179 A 9/1994 Fritschi et al.
5,397,150 A 3/1995 Commier et al.
5,462,318 A 10/1995 Cooke
5,499,461 A * 3/1996 Danezin ..... A43B 5/0401 36/117.1
5,542,197 A 8/1996 Vincent
5,551,728 A 9/1996 Barthel et al.
5,553,883 A 9/1996 Erb
5,558,354 A 9/1996 Lion
5,570,522 A * 11/1996 Olson ..... A43C 11/008 36/115
5,618,051 A 4/1997 Kobylenski et al.
5,649,722 A 7/1997 Champlin
5,660,416 A 8/1997 Schiele et al.
5,697,631 A 12/1997 Ratzek et al.
5,701,689 A * 12/1997 Hansen ..... A43B 7/20 36/115
5,713,587 A * 2/1998 Morrow ..... A43B 3/0073 280/14.21
5,741,023 A 4/1998 Schiele et al.
5,762,358 A 6/1998 Hale
5,765,853 A 6/1998 Erb
5,771,609 A * 6/1998 Messmer ..... A43B 5/0401 36/115
5,815,952 A * 10/1998 Bobrowicz ..... A43B 5/0401 36/117.1
5,816,590 A 10/1998 Fey et al.
5,820,139 A 10/1998 Grindl
5,884,933 A 3/1999 Trott
5,887,886 A * 3/1999 Bourdeau ..... A43B 5/0401 280/613
5,894,684 A * 4/1999 Sand ..... A43B 7/20 36/115
5,901,469 A * 5/1999 Saillet ..... A43B 3/0063 36/115
5,906,388 A 5/1999 Neiley
5,909,886 A * 6/1999 Tugutaka ..... A63C 10/04 280/14.21
5,937,546 A * 8/1999 Messmer ..... A43B 5/0401 36/115
5,941,552 A 8/1999 Beran
5,947,487 A * 9/1999 Keleny ..... A43B 5/1683 188/5
5,966,843 A * 10/1999 Sand ..... A43B 7/20 36/115
5,966,844 A 10/1999 Hellerman et al.
5,979,082 A 11/1999 Pallatin
5,984,324 A 11/1999 Wariakois
5,984,325 A 11/1999 Acuna
6,000,711 A 12/1999 Fey et al.
6,015,161 A 1/2000 Carlson
6,041,721 A 3/2000 Weston
6,082,026 A * 7/2000 Sand ..... A43B 5/0401 36/117.1
6,089,592 A * 7/2000 Negus ..... A63C 5/03 280/11.36
6,105,992 A 8/2000 Schaller et al.
6,116,634 A * 9/2000 Mometti ..... A63C 10/04 280/613
6,126,625 A * 10/2000 Lundberg ..... A61F 5/0118 602/27
6,138,384 A * 10/2000 Messmer ..... A43B 5/0401 36/115
6,206,402 B1 3/2001 Tanaka
6,231,057 B1 5/2001 Reuss et al.
6,272,772 B1 * 8/2001 Sherman ..... A43B 5/16 36/89
6,276,708 B1 8/2001 Hogstedt
6,390,492 B1 5/2002 Bumgarner et al.
6,464,237 B1 10/2002 Gracie
6,505,841 B1 1/2003 Kessler et al.
6,523,851 B1 2/2003 Maravetz
6,554,295 B2 4/2003 Rittmeyer
6,578,865 B1 6/2003 Chaput
6,609,720 B2 8/2003 Marmonier
6,616,151 B1 9/2003 Golling
6,648,365 B1 11/2003 Laughlin et al.
6,705,633 B2 3/2004 Poscich
6,729,642 B2 5/2004 Gouzes et al.
6,733,030 B2 5/2004 Okajima et al.
6,786,502 B2 9/2004 Carlson
6,792,702 B2 * 9/2004 Borsoi ..... A43B 5/0401 36/117.6
6,863,285 B2 3/2005 Gonthier
6,969,075 B2 11/2005 Dean et al.
7,029,023 B2 * 4/2006 Fougere ..... A63C 10/04 280/11.36
7,073,813 B2 7/2006 Martin et al.
7,097,194 B2 8/2006 Kogler
7,147,233 B2 * 12/2006 Edmond ..... A63C 10/04 280/14.22
7,204,495 B2 4/2007 Reuss et al.
7,207,592 B2 * 4/2007 Pascal ..... A63C 10/04 280/14.24
7,232,147 B2 * 6/2007 Couderc ..... A63C 10/04 280/611

(56) References Cited

U.S. PATENT DOCUMENTS

| | | | | |
|---|---|---|---|---|
| 7,246,811 | B2 * | 7/2007 | Martin | A63C 10/04 280/14.22 |
| 7,267,357 | B2 | 9/2007 | Miller et al. | |
| 7,306,241 | B2 * | 12/2007 | Cunningham | A43C 11/1466 280/14.22 |
| 7,320,474 | B2 | 1/2008 | Quellais et al. | |
| 7,367,579 | B2 * | 5/2008 | Elkington | A63C 10/04 280/11.3 |
| 7,427,079 | B2 * | 9/2008 | Piva | A63C 10/04 280/14.24 |
| 7,503,579 | B2 * | 3/2009 | Couderc | A63C 10/24 280/11.36 |
| 7,516,976 | B2 * | 4/2009 | Cunningham | A43C 11/146 280/11.36 |
| 7,568,719 | B2 * | 8/2009 | Sauter | A63C 10/04 280/619 |
| 7,621,542 | B2 | 11/2009 | Warburton et al. | |
| 7,669,880 | B2 * | 3/2010 | Doyle | A43C 11/146 280/11.36 |
| 7,681,904 | B2 | 3/2010 | Ekberg | |
| 7,694,994 | B2 * | 4/2010 | Lang | A43C 11/1466 280/11.36 |
| 7,823,905 | B2 | 11/2010 | Ritter | |
| 7,832,754 | B2 | 11/2010 | Girard et al. | |
| 7,931,292 | B2 | 4/2011 | Miralles | |
| 7,992,888 | B2 | 8/2011 | Steere | |
| 8,033,564 | B2 | 10/2011 | Riepler et al. | |
| 8,132,818 | B2 | 3/2012 | Cunningham et al. | |
| 8,167,321 | B2 | 5/2012 | Cunningham et al. | |
| 8,226,109 | B2 | 7/2012 | Ritter | |
| 8,348,299 | B2 | 1/2013 | Ekberg | |
| 8,371,605 | B2 * | 2/2013 | Neiley | A63C 10/04 280/611 |
| 8,469,372 | B2 | 6/2013 | Kloster et al. | |
| 8,480,546 | B2 * | 7/2013 | Spencer | A43B 7/00 482/44 |
| 8,662,505 | B2 | 3/2014 | Cunningham et al. | |
| 8,684,394 | B2 * | 4/2014 | Smith | A63C 10/28 280/14.22 |
| 8,708,371 | B2 | 4/2014 | Balun | |
| 8,720,910 | B2 * | 5/2014 | Caslowitz | A43B 5/16 24/70 SK |
| 8,733,783 | B2 | 5/2014 | Kloster et al. | |
| 8,764,043 | B2 | 7/2014 | Neubauer et al. | |
| 8,857,845 | B2 * | 10/2014 | Ohlheiser | A63C 10/045 280/611 |
| 2004/0061311 | A1 * | 4/2004 | De Bortoli | A63C 10/04 280/623 |
| 2004/0169343 | A1 * | 9/2004 | Fougere | A63C 10/04 280/11.36 |
| 2005/0057009 | A1 * | 3/2005 | Couderc | A63C 10/04 280/11.36 |
| 2005/0161911 | A1 * | 7/2005 | Piva | A63C 10/04 280/623 |
| 2005/0177083 | A1 * | 8/2005 | Heil | A61F 5/0111 602/27 |
| 2005/0253347 | A1 | 11/2005 | Martin et al. | |
| 2006/0175802 | A1 * | 8/2006 | Maravetz | A63C 10/04 280/619 |
| 2007/0170697 | A1 * | 7/2007 | Couderc | A63C 10/24 280/619 |
| 2007/0216137 | A1 | 9/2007 | Ritter | |
| 2008/0185814 | A1 | 8/2008 | Riepler et al. | |
| 2009/0146396 | A1 * | 6/2009 | Hahnenberger | A63C 10/06 280/617 |
| 2009/0250906 | A1 | 10/2009 | Ritter | |
| 2010/0102522 | A1 | 4/2010 | Kloster et al. | |
| 2010/0304937 | A1 * | 12/2010 | Spencer | A43B 7/00 482/79 |
| 2011/0184326 | A1 * | 7/2011 | Ingimundarson | A61F 5/0123 602/26 |
| 2011/0197362 | A1 * | 8/2011 | Chella | A61F 5/0111 5/650 |
| 2011/0254251 | A1 * | 10/2011 | Jung | A63C 10/045 280/617 |
| 2012/0256395 | A1 | 10/2012 | Ritter | |
| 2012/0274036 | A1 | 11/2012 | Kloster et al. | |
| 2012/0292887 | A1 * | 11/2012 | Ohlheiser | A63C 10/045 280/611 |
| 2013/0147159 | A1 * | 6/2013 | Neiley | A63C 10/04 280/633 |
| 2013/0214512 | A1 | 8/2013 | Kloster et al. | |
| 2013/0277947 | A1 | 10/2013 | Kloster et al. | |
| 2014/0167392 | A1 * | 6/2014 | Kloster | A63C 10/02 280/633 |
| 2014/0210187 | A1 | 7/2014 | Ritter | |
| 2014/0232087 | A1 | 8/2014 | Bulan | |
| 2014/0291965 | A1 | 10/2014 | Kloster et al. | |
| 2015/0014962 | A1 | 1/2015 | Rayner | |
| 2015/0021881 | A1 * | 1/2015 | Hutchison | A63C 10/06 280/621 |
| 2015/0048597 | A1 * | 2/2015 | Tudor | A43C 9/02 280/619 |

FOREIGN PATENT DOCUMENTS

| | | |
|---|---|---|
| DE | 91 08 618.3 | 1/1992 |
| DE | 296 18 514 U1 | 10/1996 |
| EP | 0 362 782 A2 | 4/1990 |
| EP | 0 680 775 B1 | 11/1995 |
| WO | WO 98/17355 | 4/1998 |

OTHER PUBLICATIONS

U.S. Appl. No. 12/604,256, filed Oct. 22, 2009, including its prosecution history.

Web page showing Salomon SNS Pilot Combi binding, www.salmon.com/us/products/sns-pilot-combi.html, dated Mar. 20, 2012.

U.S. Appl. No. 13/458,560, filed Apr. 27, 2012, including its prosecution history.

U.S. Appl. No. 13/763,453, filed Feb. 8, 2013, including its prosecution history.

U.S. Appl. No. 13/925,546, filed Jun. 24, 2013, including its prosecution history.

U.S. Appl. No. 14/287,938, filed May 27, 2014, including its prosecution history.

* cited by examiner

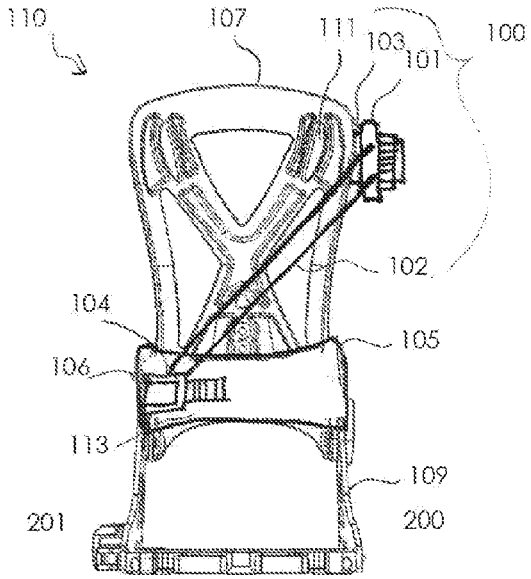
FIG. 19
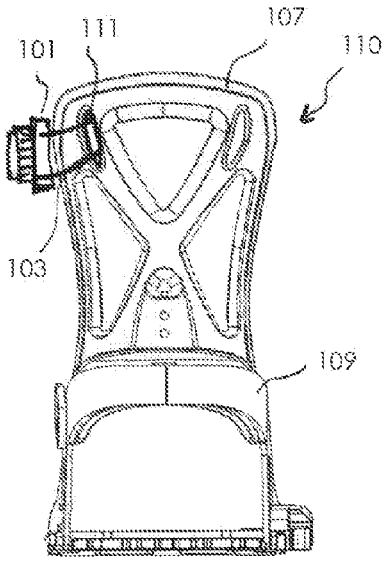
FIG. 20
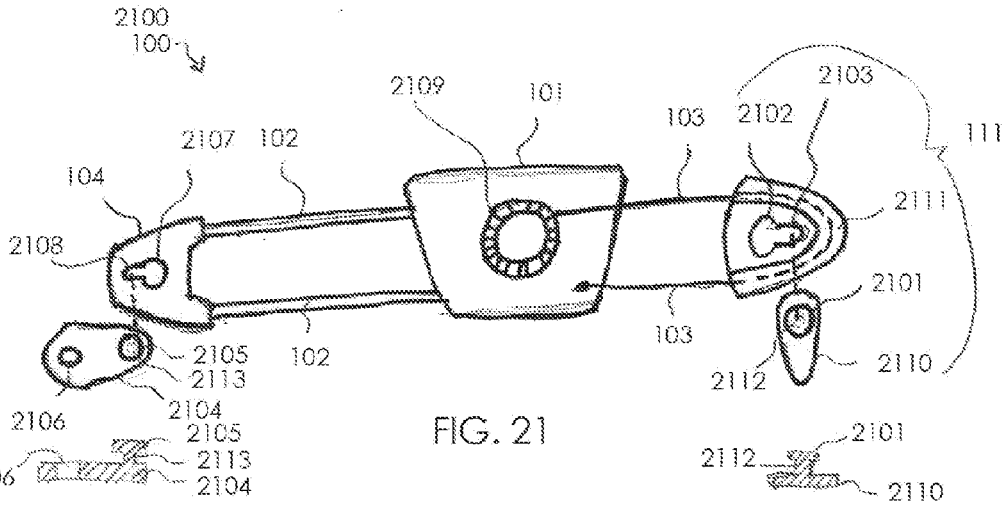
FIG. 21
FIG. 21B
FIG. 21A

SPLITBOARD BINDING WITH ADJUSTABLE LEVERAGE DEVICES

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

The present disclosure generally relates to split snowboards, also known as splitboards, and includes the disclosure of a touring snowboard boot binding with adjustable leverage devices relating to, or configured to be used with, for example, a splitboard for adjusting posterior leverage for riding downhill in ride mode and adjusting lateral leverage for climbing uphill in tour mode. The present disclosure also includes systems and methods relating to touring snowboard boot binding with adjustable leverage devices.

Splitboards are used for accessing backcountry terrain. Splitboards have a "ride mode" and a "tour mode." In ride mode, the splitboard is configured with at least two skis held together to form a board similar to a snowboard with bindings mounted somewhat perpendicular to the edges of the splitboard. In ride mode, a user can ride the splitboard down a mountain or other decline, similar to a snowboard. In tour mode, the at least two skis of the splitboard are separated and configured with bindings that are typically mounted like a cross country free heel ski binding. In tour mode, a user normally attaches skins to create traction when climbing up a hill. In some instances, additional traction beyond what the skins provide is desirable and crampons are used. When a user reaches the top of the hill or desired location the user can change the splitboard from tour mode to ride mode and snowboard down the hill.

SUMMARY

Some embodiments provide a touring snowboard boot or binding configured to receive a boot. In some embodiments, the touring snowboard binding can comprise an adjustable lateral leverage device comprising at least one first attachment generally at a top corner of the highback, at least one second attachment on the opposing side of the binding generally at an ankle portion of the boot or binding, an adjustable tensioning element extending diagonally between the at least one first attachment and the at least one second attachment, wherein when the tension in the adjustable lateral leverage device is increased the lateral support to the boot is increased proportionally and wherein when the tension in the adjustable lateral leverage device is decreased the lateral support to the boot is decreased proportionally.

Other embodiments provide a touring snowboard binding configured to receive a boot, the touring snowboard binding comprising at least one base portion, a heel cup, a highback, at least one attachment element for retaining the boot in the binding, an adjustable posterior leverage device, the adjustable posterior leverage device comprising a forward lean piece rotatably adjustable between a first position with minimal posterior support for tour mode and a second position of desired posterior support for ride mode, wherein the second position can be pre-set to a plurality of ride mode posterior support angles, wherein the rotation angle between the first position and second position can be generally about a quarter rotation.

BRIEF DESCRIPTION OF THE DRAWINGS

These and other features, aspects, and advantages of the disclosed apparatus, systems, and methods will now be described in connection with embodiments shown in the accompanying drawings, which are schematic and not necessarily to scale. The illustrated embodiments are merely examples and are not intended to limit the apparatus, systems, and methods. The drawings include the following figures, which can be briefly described as follows:

FIG. 19 is a front view of a touring snowboard binding with a lateral leverage device attached to the highback at a first attachment and attached to the ankle strap at a second attachment.

FIG. 20 is a back view of a touring snowboard binding with a lateral leverage device.

FIG. 21 is a detailed view of a first embodiment of a lateral leverage device. FIG. 21A is a cross-sectional view of a highback attachment. FIG. 21B is a cross-sectional view of a quick attachment.

DETAILED DESCRIPTION

Because a splitboard is used to ride as a snowboard down the hill and hike or tour up the hill as skis, a user has different leverage requirements while in "ride mode" than in "tour mode." A snowboard has a toe side edge and a heel side edge. In order to generally have the same performance turn on the toe side edge and heel side edge, standard snowboard bindings allow a user to provide extra leverage to the heel side edge through the use of a highback. Highbacks have forward lean adjustments to increase or decrease the amount of posterior leverage a user can apply to the heel edge of the snowboard by increasing the support of a user's calf with increased forward lean and decreasing the support of a user's calf with decreased forward lean. Most forward lean adjustments require a number of actions to adjust or they do not provide fine adjustment to achieve the desired forward lean angle. In "ride mode" the user of the splitboard will benefit from positive forward lean on the highback to be able to better leverage the heel side turn. In "tour mode" the user of a splitboard will benefit from negative forward lean on the highback to be able to stride without pressure on the calf. There is a need in the art for a splitboard binding which has the ability to quickly go from a negative forward lean angle to a positive forward lean angle.

In addition to the ability to adjust heel side leverage, splitboarders need the ability to adjust lateral leverage. While in "ride mode" users need to be able to move freely laterally for the ride down the mountain to feel like they are on a normal snowboard. While in "tour mode" users desire lateral leverage, to more easily grip firm or icy snow while touring up the hill. Some splitboarders choose to use stiff snowboard boots or ski boots to achieve this lateral leverage to the detriment of the ride down. Others will use ski boot power straps or utility straps around the top of their highbacks and boots to achieve marginal lateral leverage improvement. Power straps and utility straps around the highback rely on the stiffness of the highback to provide lateral support. The highback will twist and not provide the best lateral support. In addition, the power strap and utility straps need to be attached to use and detached to remove a boot from the binding. There is a need in the art for a splitboard binding or splitboard boot which has the ability to quickly turn lateral leverage on and off.

Figure 43:
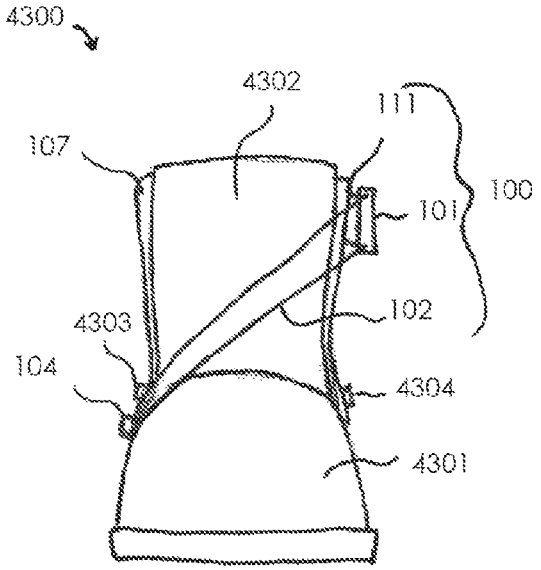
FIG. 43 is a front view of a snowboard boot with integrated binding features.

Turning to the drawings, FIGS. 1 through 6 illustrate an example lateral leverage device 100 mounted to touring snowboard binding 110. Touring snowboard binding 110 is the binding for the right foot of a right and left pair of touring snowboard bindings. The left binding being a mirror image of the touring snowboard binding 110. Touring snowboard binding 110 can include a heelcup 109, highback 107 and ankle strap 105. Ankle strap 105 can be fixed to one side of heelcup 109 at the ankle portion of the binding and releasably attached to the opposing side through ratchet ladder 113 and ratchet 106. Ratchet ladder 113 is attached to heelcup 109 at attachment point 108 at the ankle portion of the binding. Ratchet 106 can detach from ratchet ladder 113 to allow a user to insert or remove a boot from the binding. It is clear to a person of ordinary skill in the art that the snowboard boot and binding can be integrated together. The heelcup and lower portion of the binding can become part of a boot lower. FIG. 43 shows snowboard boot 4300 with binding components integrated.

Figure 1:
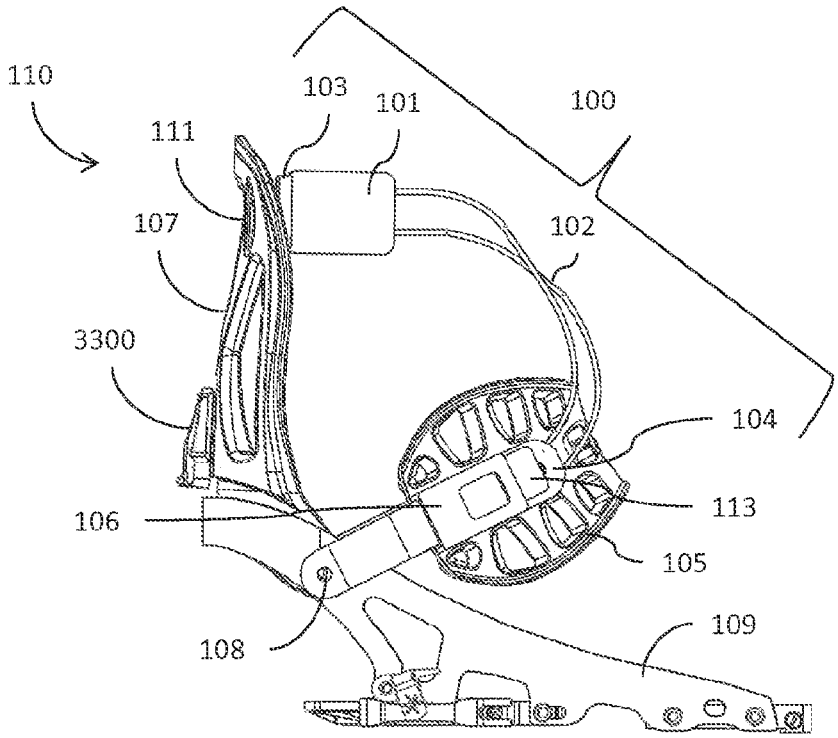
FIG. 1 is a side view of a splitboard binding with adjustable leverage devices

FIG. 1 shows a side view of an embodiment of a lateral leverage device 100 mounted to touring snowboard binding 110. Lateral leverage device 100 can attach to touring snowboard binding 110 at first attachment 111 on highback 107. First attachment 111 can be any joining device, examples being a screw and nut, press fit component, hook and loop fastener, etc. Lateral leverage device 100 can also attach to touring snowboard binding 110 at second attachment point 104, which can be attached to ankle strap 105 approximately located near ratchet 106. Lateral leverage device 100 can include tension adjustment element 101, tension element 103, and tension element 102. Tension elements 103 and 102 can be made from many materials such as, for example, cable, wire, cord, webbing, flexible plastic, semi-rigid plastic, etc. Lateral leverage device 100 can have many different embodiments, examples of which are further described in FIGS. 1-32.

FIG. 1 further shows an adjustable posterior leverage device 3300 in the tour position as further described in FIGS. 33-42. The combination of the adjustable posterior leverage device 3300 and lateral leverage device 100 gives a splitboarder the unique ability to quickly adjust leverage between a tour mode setting and a ride mode setting.

Figure 2:
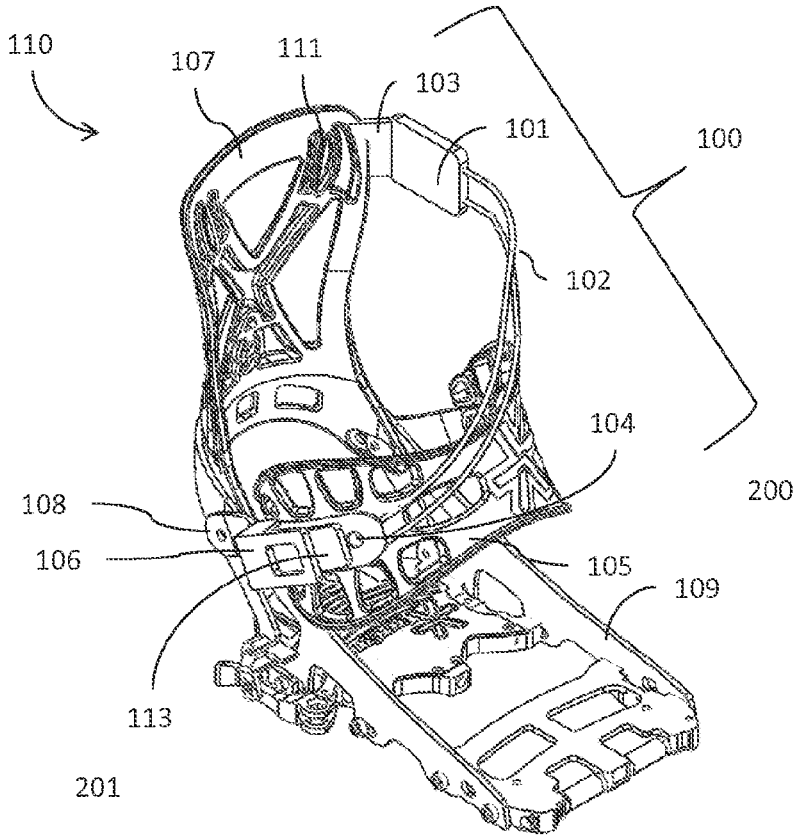
FIG. 2 is an isometric view of a splitboard binding with adjustable leverage devices

FIG. 2 further shows an isometric view of an example lateral leverage device 100 mounted to touring snowboard binding 110. Touring snowboard binding 110 has a left side 200 and a right side 201. Lateral leverage device 100 can mount to highback 107 through first attachment 111 on a left side 200 of touring snowboard binding 110. Lateral leverage device 100 can attach can attach to ankle strap 105 on a right side 201 of touring snowboard binding 110. Lateral leverage device 100 can extend diagonally from the left side 200 across to the right side 201 of touring snowboard binding 110.

Figure 3:
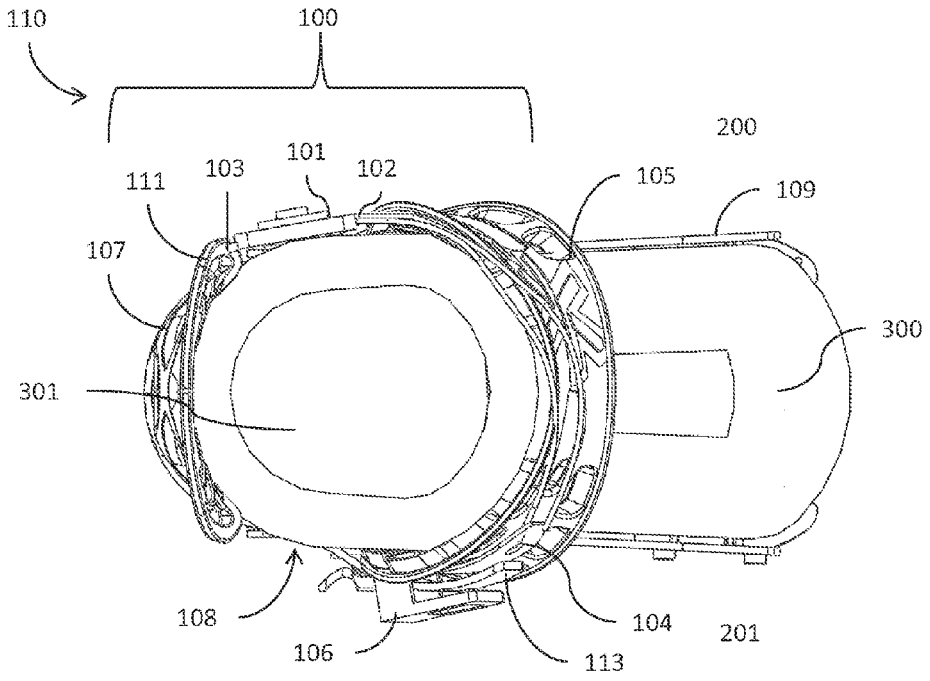
FIG. 3 is a top view of a splitboard binding with a boot with an example lateral leverage device providing lateral support.
Figure 4:
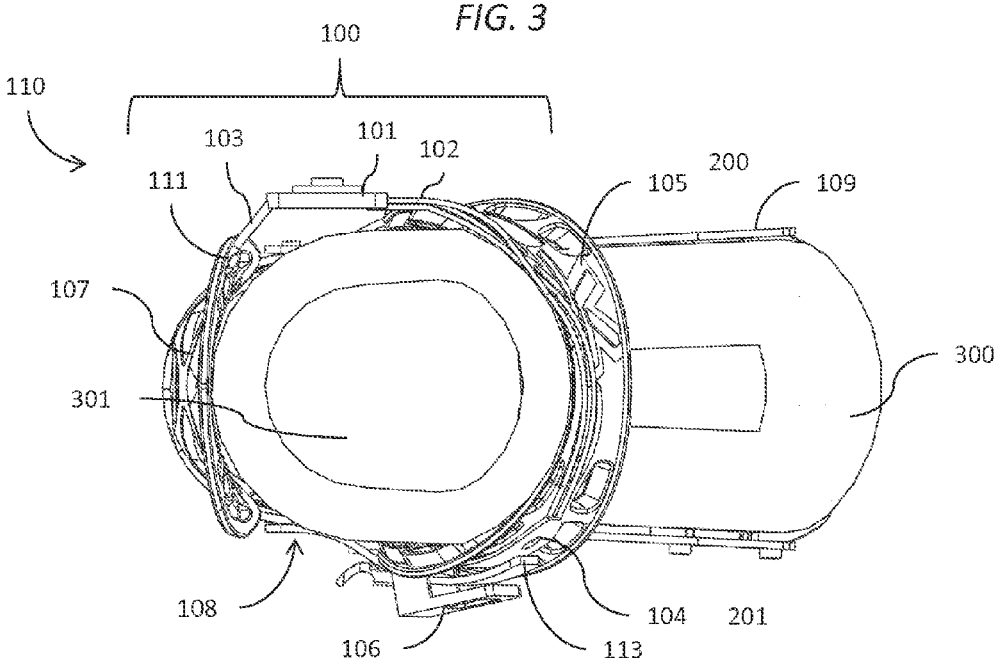
FIG. 4 is a top view of a splitboard binding with a boot with an example lateral leverage device with lateral support reduced.

FIG. 3 shows a top view of lateral leverage device 100 attached to touring snowboard bindings 110 with a snowboard boot 300. Lateral leverage device 100 can be turned on to provide lateral support to snowboard boot 300 as shown in FIG. 3 or lateral leverage device 100 can be turned off to remove lateral support to snowboard boot 300 as shown in FIG. 4. When lateral leverage device 100 is turned on to provide lateral support to snowboard boot 300 tension adjustment element 101 increases tension in tension elements 102 and 103 causing lateral leverage device 100 to tighten around the upper portion 301 of snowboard boot 300. Lateral leverage device 100 prevents lateral ankle flexion of a user by supporting the upper portion 301 of snowboard boot 300.

FIG. 4 shows a top view of lateral leverage device 100 turned off Tension adjustment element 101 reduces tension in the tension elements 102 and 103 such that the lateral leverage device 100 is slack, removing support to the upper portion 301 of snowboard boot 300 allowing a user to laterally flex their ankle.

Figure 5:
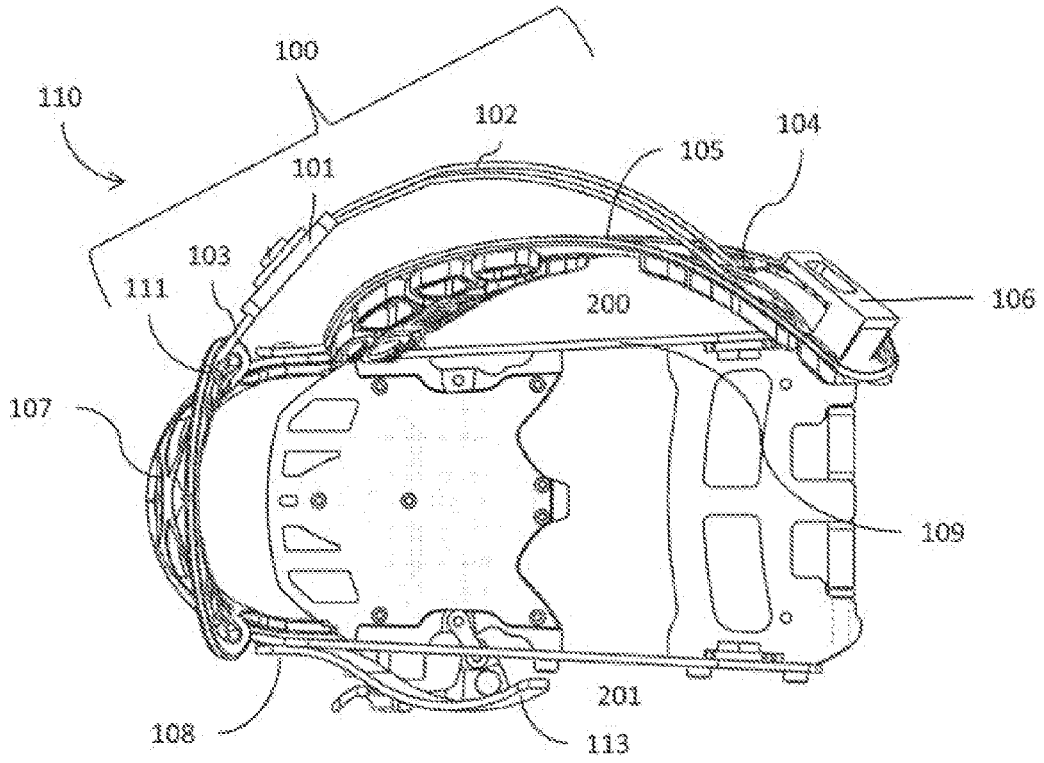
FIG. 5 is a top view of a splitboard binding with an example lateral leverage device with straps open.

FIG. 5 shows a top view of lateral leverage device 100 attached to touring snowboard binding 110 with the straps open to allow for insertion and removal of snowboard boot 300. With the second attachment of lateral leverage device 100 attached to ankle strap 105 near ratchet 106, the lateral leverage device 100 does not need to be detached to insert or remove snowboard boot 300 from the touring binding 110.

Figure 6:
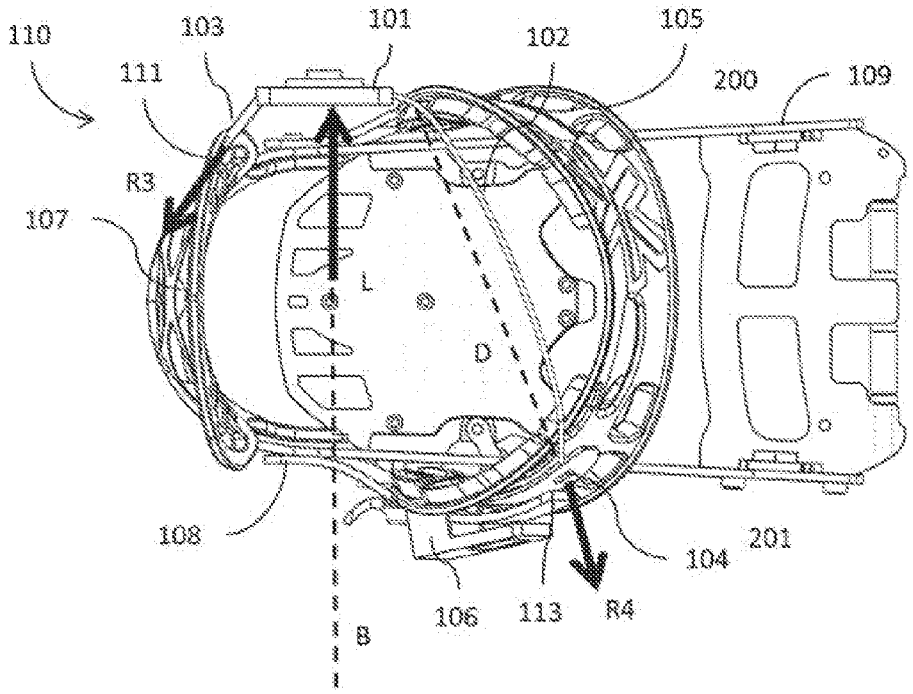
FIG. 6 is a top detailed view showing the force flow of a splitboard binding with an example lateral leverage device.

FIG. 6 shows a top detailed view of lateral leverage device 100 mounted to touring snowboard binding 110, showing the force flow through lateral leverage device 100. Certain elements have been removed for clarity of description. In some embodiments, lateral force "L" (from upper portion 301 of snowboard boot 300 which is not shown) is applied to lateral leverage device 100 at or around tension adjustment element 101. Lateral leverage device 100 reacts lateral force "L" at first attachment 111 on highback 107 with reaction force R3 and at second attachment 104 on ankle strap 105 with reaction force R4. Reaction force R3 is on the opposite side of line of action "B" of lateral force "L" than reaction force R4 creating a force flow without any reaction moments. Having reaction force R4 on the opposite side of line of action "B" than reaction force R3 allows tension element 102 to generally follow a straight path "D" between adjustable tension element 101 and second attachment 104 limiting the lateral movement of tension adjustment element 101 past neutral position "A". A more simplified explanation of the force flow of lateral leverage device 100 is described below with respect to FIGS. 14 and 15.

Figure 7:
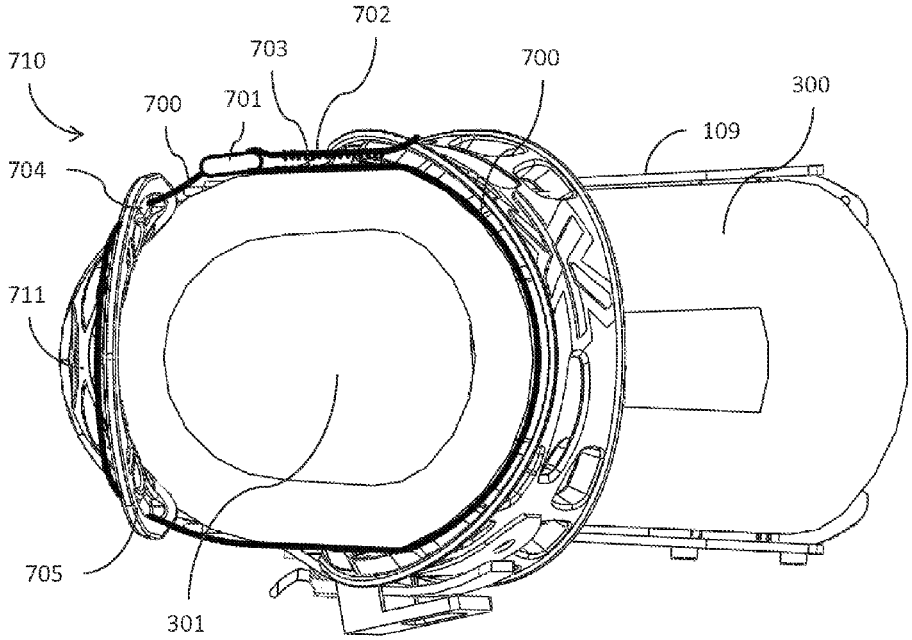
FIG. 7 is a top view of a known splitboard binding with a third strap.

Turning to FIGS. 7-11, the embodiments disclosed herein provide unique advantages over the existing devices of FIGS. 7-11. FIG. 7 shows a top view of a known third strap 700 attached to touring snowboard binding 710. The third strap 700 is attached to highback 711 at attachment points 704 and 705. The third strap 700 is tightened around upper portion 301 of snowboard boot 300 by looping the strap through d-ring 701 and attaching hooks 702 to loops 703. The third strap 700 has been made from nylon webbing or semi-rigid plastic.

Figure 8:
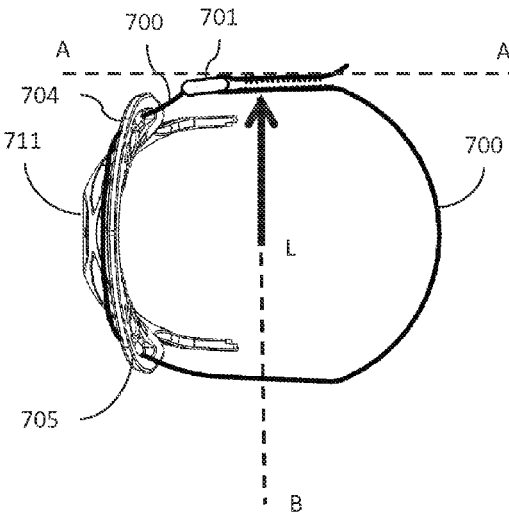
FIG. 8 is a detailed top view of a splitboard binding with a third strap.
Figure 9:
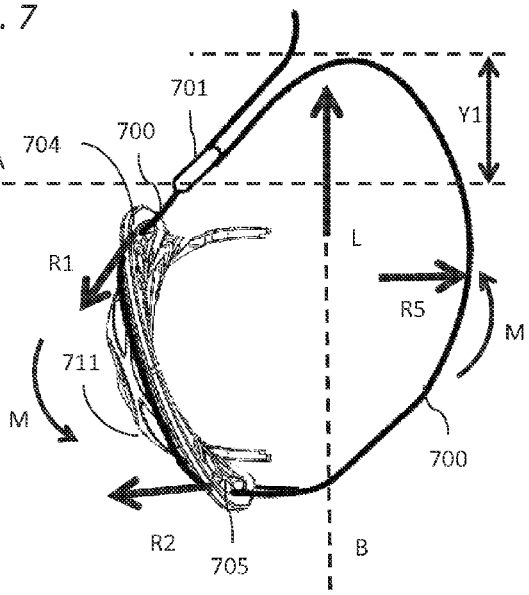
FIG. 9 is a detailed top view of a splitboard binding with a third strap.

FIG. 8 is a detailed top view of the third strap 700 in the neutral position just before lateral force "L" is applied from upper portion 301 of snowboard boot 300. Neutral position "A" shown as a dashed line shows the initial lateral position of the third strap 700. FIG. 9 is a detailed top view of the third strap 700 in the equilibrium position when lateral force "L" from snowboard boot 300 is applied to the third strap 700. Highback 711 twists along path "M" due to the moment induced by lateral force "L". The third strap 700 is laterally displaced a distance shown as Y1 due to the third strap 700 attempting to align with the line of action "B" of lateral force "L". The third strap 700 has reaction force R1 at attachment point 704 on highback 711, reaction force R2 at attachment point 705 on highback 711, and reaction force R5 due to the compression of the third strap 700 on upper portion 301 of snowboard boot 300. A simplified explanation of the third strap 700 is set forth below with respect to FIGS. 10 and 11.

Figure 10:
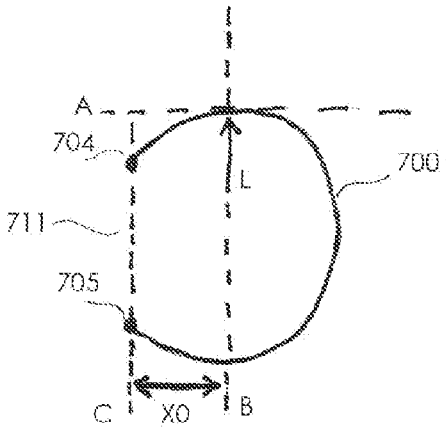
FIG. 10 is a top view of a simplified view of the third strap in the neutral position.

FIG. 10 shows a top view of a simplified view of the third strap 700 in the neutral position just before lateral force "L" is applied from upper portion 301 of snowboard boot 300. Dashed line "C" is the plane of the highback 711 which is not shown. The third strap 700 is attached to highback 711 at attachment points 704 and 705. The neutral lateral position of the third strap 700 is shown as dashed line "A". X0 is the distance between the plane of highback 711 dashed line "C" and the line of action "B" of lateral load "L". Both attachment points 704 and 705 are on the left side of line of action "B" of lateral load "L".

Figure 11:
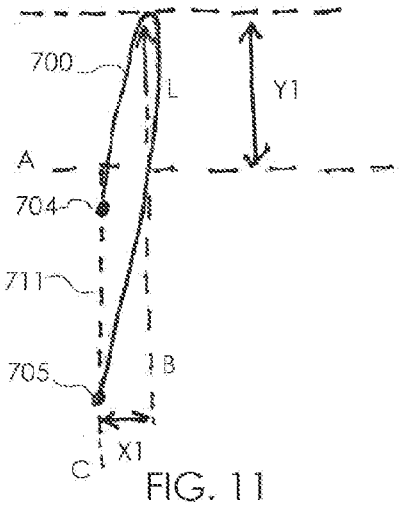
FIG. 11 shows a top view of a simplified view of the third strap in the equilibrium position.

FIG. 11 shows a top view of a simplified view of the third strap 700 in the equilibrium position. Snowboard boot 300 is not included in the figure to highlight the lateral translation of the system. The length of the third strap 700 is sized such that it would tightly fit around upper portion 301 of snowboard boot 300. Once lateral load "L" is applied to the third strap 700 it will move to the equilibrium position as shown. The distance between line of action "B" and plane of highback "C" will decrease from X0 to X1. The lateral position of the third strap 700 will move from neutral position "A" by a distance Y1 due to the third strap 700 folding and elongating and highback 711 twisting as shown in FIG. 9. If the third strap 700 is made from a nylon webbing or like material distance Y1 will be the greatest. If the third strap 700 is made from a more rigid material, such as a semi-rigid plastic, Y1 will be slightly decreased due to the amount the third strap 700 can fold on itself, but more torque will be applied to highback 711.

Figure 12:
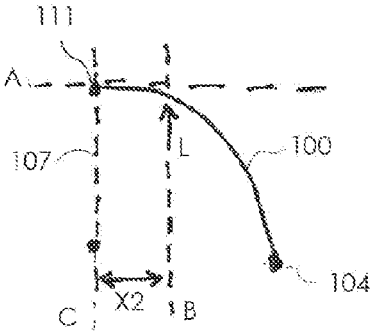
FIG. 12 shows a top view of a simplified view of lateral leverage device as a simple flexible strap.

FIG. 12 shows a top view of a simplified view of lateral leverage device 100 as a simple flexible strap, cord or wire. Dashed line "C" shows the plane of highback 107. In the illustrated embodiment, lateral leverage device 100 is attached to highback 107 at first attachment 111 and is attached to heelcup 109 (not shown) at second attachment 104. Second attachment 104 can be attached directly to heelcup 109 or indirectly to heelcup 109 through ankle strap 105 (not shown, see FIG. 1-3). The neutral lateral position of lateral leverage device 100 is shown as dashed line "A". X2 is the distance between the plane "C" of highback 107 and line of action "B". First attachment 111 is on the left side of line of action "B" of lateral force "L" and second attachment 104 is on the right side of line of action "B" of lateral force "L".

Figure 13:
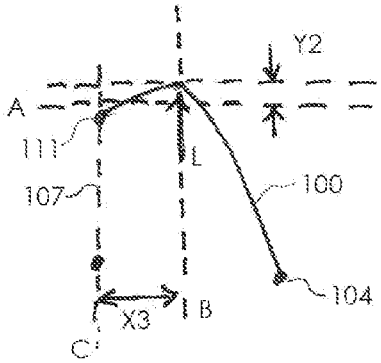
FIG. 13 shows a top view of a simplified view of lateral leverage device as a simple flexible strap, cord or wire in the equilibrium position.

FIG. 13 shows a top view of a simplified view of lateral leverage device 100 as a simple flexible strap, cord or wire in the equilibrium position. Snowboard boot 300 is not included in the figure to highlight the lateral translation of the system. The length of lateral leverage device 100 is sized such that it would be tightly fit around upper portion 301 of snowboard boot 300. Once lateral load "L" is applied to lateral leverage device 100 it will move to the equilibrium position as shown. The distance between line of action "B" and plane of highback "C" will marginally decrease from X2 to X3. The lateral position of lateral leverage device 100 will move from neutral position "A" by a distance Y2 due to lateral leverage device 100 will marginally straighten and elongate between second attachment 104 and lateral load "L", Because first attachment 111 and second attachment 104 are on opposite sides of line of action "B" of lateral load "L" the lateral displacement Y2 is substantially lower than the lateral displacement Y1 of the third strap 700 shown in FIG. 11.

Figure 14:
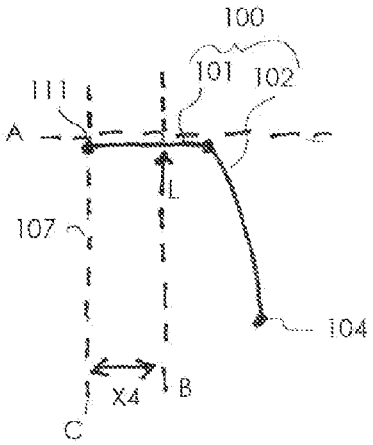
FIG. 14 shows a top view of a simplified view of lateral leverage device with an adjustable tension element as a rigid material and a tension element as a flexible material.

FIG. 14 shows a top view of a simplified view of lateral leverage device 100 with adjustable tension element 101 as a rigid material and tension element 102 as a flexible material. Dashed line "C" shows the plane of highback 107. Lateral leverage device 100 is attached to highback 107 at first attachment 111 and is attached to heelcup 109 (not shown) at second attachment 104. Second attachment 104 can be attached directly to heelcup 109 or indirectly to heelcup 109 through ankle strap 105 (not shown, see FIG. 1-3). The neutral lateral position of lateral leverage device 100 is shown as dashed line "A". X4 is the distance between the plane "C" of highback 107 and line of action "B". First attachment 111 is on the left side of line of action "B" of lateral force "L" and second attachment 104 is on the right side of line of action "B" of lateral force "L". Adjustable tension element 101 as a rigid material extends from first attachment 111 past the line of action "B" of lateral force "L".

Figure 15:
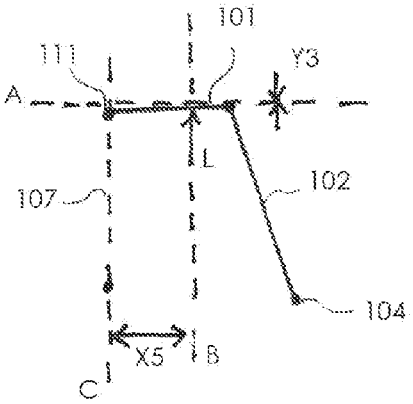
FIG. 15 shows a top view of a simplified view of lateral leverage device with an adjustable tension element as a rigid material and a tension element as a flexible material in the equilibrium position.

FIG. 15 shows a top view of a simplified view of lateral leverage device 100 with adjustable tension element 101 as a rigid material and tension element 102 as a flexible material in the equilibrium position. Snowboard boot 300 is not included in the figure to highlight the lateral translation of the system. The length of lateral leverage device 100 is sized such that it would be tightly fit around upper portion 301 of snowboard boot 300. Once lateral load "L" is applied to lateral leverage device 100 it will move to the equilibrium position as shown. The distance between line of action "B" and plane of highback "C" will not decrease from X4 to X5, such that X4 approximately equals X5. Y3 is the lateral displacement from neutral position "A". The lateral position of lateral leverage device 100 will not move from neutral position "A" such that Y3 is approximately zero. In some embodiments, because first attachment 111 and second attachment 104 are on opposite sides of line of action "B" of lateral load "L" and adjustable tension element 101 as a rigid material extends past line of action "B", tension element 102 cannot elongate when lateral load "L" is applied and the lateral displacement Y3 equals approximately zero.

Figure 16:
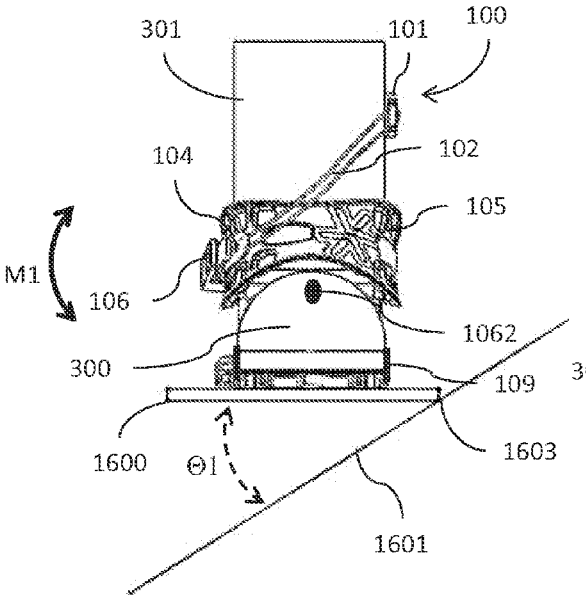
FIG. 16 is a front view of a lateral leverage device in use.

FIG. 16 is front view of an embodiment of the lateral leverage device 100 in use. Snowboard boot 300 is strapped into touring snowboard binding 110. Touring snowboard binding is attached to ski 1600 in the tour mode position. Ski 1600 is on snow slope 1601 in the side hill position. Lateral leverage device 100 is turned on as described in FIG. 3. Adjustable tension element 101 presses against the upper portion 301 of snowboard boot 300 preventing the ankle of a user, shown as pivot point 1602, from rotating about path M1 allowing the user to attain edge angle theta1 and greater edge traction between ski 1600 and snow slope 1601 at edge 1603.

Figure 17:
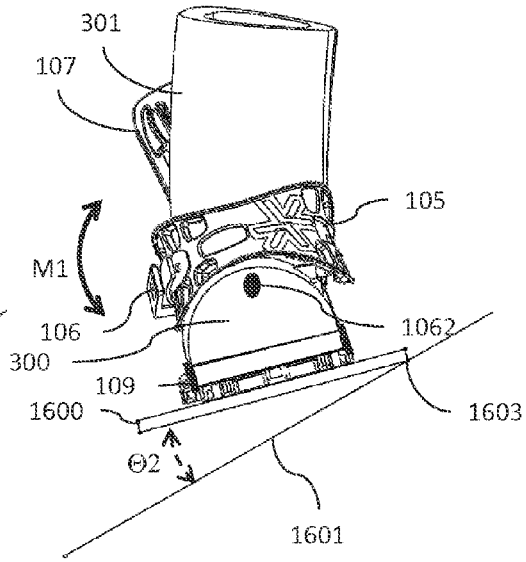
FIG. 17 is a front view of a snowboard boot strapped into a touring binding without a lateral leverage device.

FIG. 17 is front view of a snowboard boot 300 strapped into a touring binding without lateral leverage device 100. Touring snowboard binding is attached to ski 1600. Ski 1600 is on snow slope 1601 in the side hill position. Without lateral leverage device 100 the upper portion 301 of snowboard boot 300 has no support, thus allowing a user's ankle 1602 to pivot about path M1 causing the edge angle θ2 to be less than θ1 in FIG. 16 reducing edge traction between ski 1600 and snow slope 1601 at edge 1603.

Figure 18:
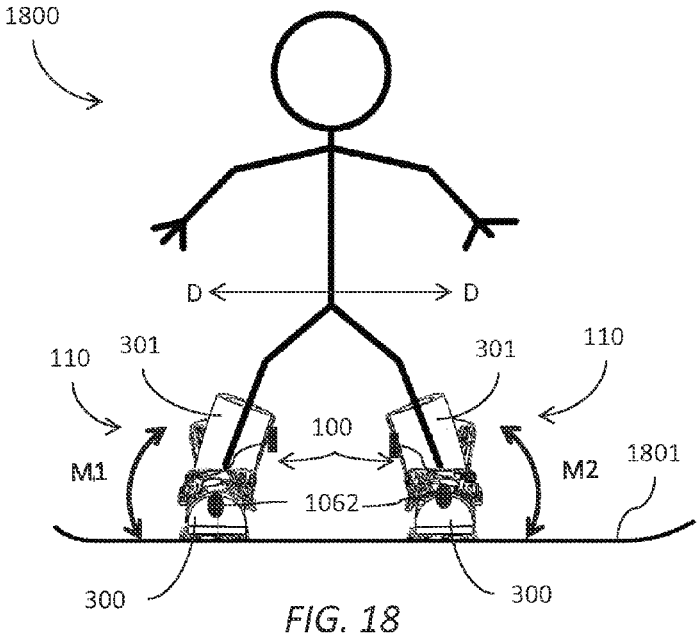
FIG. 18 is a front view of a splitboarder on a splitboard with touring snowboard bindings.

FIG. 18 is a front view of a stick figure splitboarder 1800 on splitboard 1801 with touring snowboard bindings 110. The lateral leverage device 100 is turned off allowing splitboarder 1800 to move freely along path D, fore and aft along the length of the snowboard, while flexing ankles 1602 along paths M1 and M2. Ankle motion is a key element to snowboarding because, for example, ankle motion allows the splitboarder 1801 to absorb terrain, to feel changes in snow conditions, to apply leverage to the snowboard, and to utilize maximum range of motion.

Advantageously, lateral leverage device 100 allows a splitboarder 1800 to attain maximum lateral ankle support while touring, as shown in FIG. 16, and reduce lateral ankle support while snowboarding, as shown in FIG. 18. Lateral leverage device 100 can be adjusted between the on position and off position quickly to allow for ease of use. In FIG. 5, an embodiment is shown where lateral leverage device 100 can attach to touring snowboard binding 110 in such a way that a user can insert or remove their boot from the binding without disconnecting or opening the lateral leverage device 100.

FIG. 19 is a front view of touring snowboard binding 110 with lateral leverage device 100 attached to the highback 107 at first attachment 111 and attached to ankle strap 105 at second attachment 104. Tension element 102 extends diagonally across touring snowboard binding 110 from left side 200 to right side 201. FIG. 20 is a back view of touring snowboard binding 110 with lateral leverage device 100 attached to the highback 107 at first attachment 111.

FIG. 21 is a detailed view of a first embodiment 2100 of lateral leverage device 100. In some embodiments, adjustable tension element 101 has spool 2109 mounted to increase and decrease tension on tension element 103, which is shown as a cable or cord. Tension in tension element 103 is increased by winding tension element 103 onto spool 2109 to decrease the length of cable or cord. Tension in tension element 102 is decreased by unwinding tension element 103 from spool 2109 to increase the length of cable or cord. First attachment 111 can include a cable housing 2111 which tension element 103 routes through. First attachment 111 can also include key hole 2102 and slot 2103. First attachment 111 can further include highback attachment 2110 with shoulder 2101 and pin 2112.

FIG. 21A shows a cross-sectional view of highback attachment 2110. In the illustrated embodiment, shoulder 2101 can slide through key hole 2102 and then slide down slot 2103 to attach to highback attachment 2110. Second attachment 104 can have key hole 2107 and slot 2108. Second attachment 104 can attach to quick attachment 2104 with shoulder 2105, pin 2113, and mounting hole 2106. Shoulder 2105 can slide through key hole 2107 and then slide down slot 2108 to attach second attachment 104 to quick attachment 2104. FIG. 21B is a cross-sectional view of quick attachment 2104.

Figure 22:
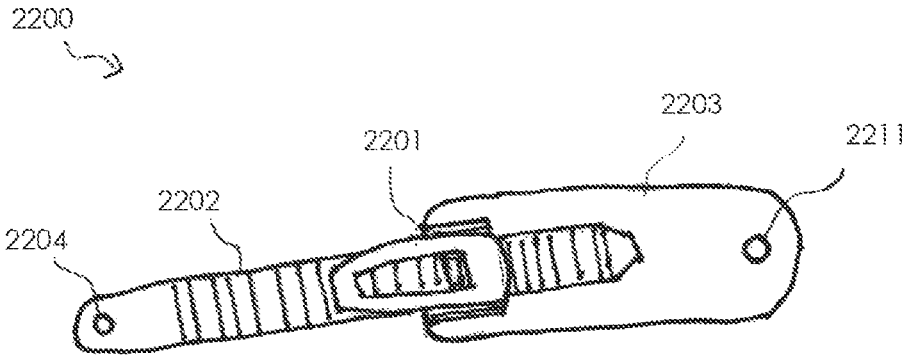
FIG. 22 is a detailed view of a second embodiment of a lateral leverage device.

FIG. 22 is a detailed view of a second embodiment 2200 of lateral leverage device 100. In such an embodiment, adjustable tension element 2201 is a lever driven ratchet. Tension element 2203 is a semi-rigid piece of plastic with first attachment hole 2211 to attach to highback 107. Tension element 2202 is a ladder strap with second attachment 2204.

Figure 23:
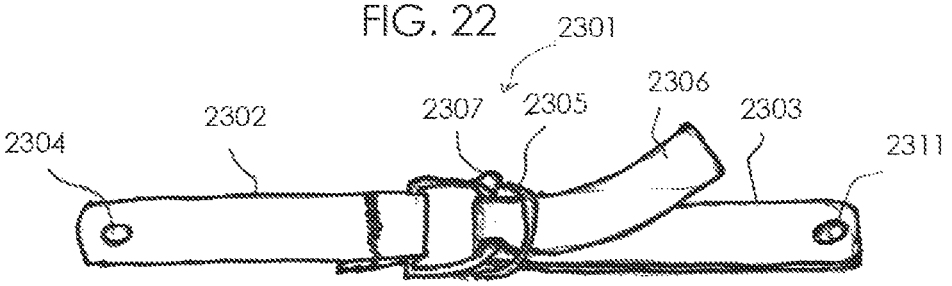
FIG. 23 is a detailed view of a third embodiment of a lateral leverage device.

FIG. 23 is a detailed view of a third embodiment 2300 of lateral leverage device 100. In such an embodiment, adjustable tension element 2301 can be a double d-ring with a first d-ring 2307 and a second d-ring 2305. Tension element 2303 is routed through first and second d-rings 2307 and 2305 such that tension element 2303 is crimped to maintain the desired length. Tension element 2303 can be a piece of webbing with second attachment 2304.

Figure 24:
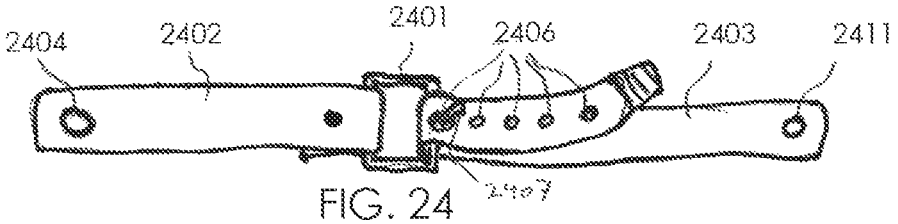
FIG. 24 is a detailed view of a fourth embodiment of a lateral leverage device.

FIG. 24 is a detailed view of a fourth embodiment 2400 of lateral leverage device 100. In such an embodiment, adjustable tension element 2401 is a d-ring with tooth 2407. Tension element 2403 is a semi flexible plastic strap with holes 2406 and first attachment 2411. Tension in lateral leverage device 2400 is adjusted by selecting one of the multiple holes 2406. Tension element 2402 can be a piece of nylon webbing, a semi-flexible plastic strap, a rigid plastic strap, or a similar element.

Figure 25:
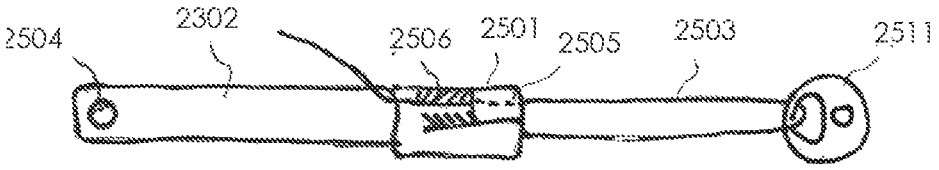
FIG. 25 is a detailed view of a fifth embodiment of a lateral leverage device.

FIG. 25 is a detailed view of a fifth embodiment 2500 of lateral leverage device 100. In such an embodiment, adjustable tension element 2501 is a jam cleat with through hole 2501 and teeth 2506. Tension element 2503 is a cord or rope. Tension element 2502 can be a piece of webbing with second attachment hole 2504.

Figure 26:
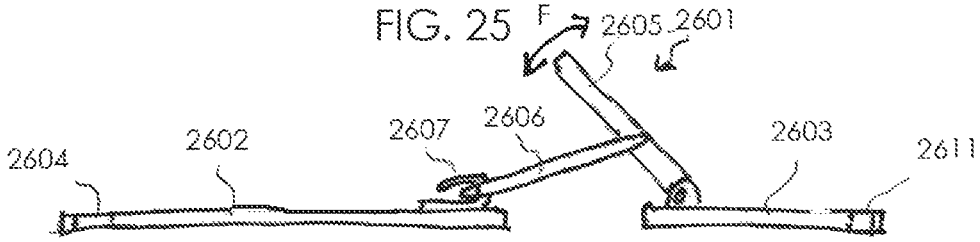
FIG. 26 is a side view of a sixth embodiment of a lateral leverage device.

FIG. 26 is a sixth embodiment 2600 of lateral leverage device 100. In such an embodiment, adjustable tension element 2601 is an over center clamp similar to a ski boot buckle. Adjustable tension element 2601 has lever 2605 and bale 2606 attached to hook 2607. When lever 2605 is rotated along path "F" the tension in this embodiment 2600 of lateral leverage device 100 increases or decreases in tension. Tension element 2602 can be a semi-rigid plastic strap, a piece of webbing, or a similar element. Sixth embodiment 2600 has first attachment 2611 and second attachment 2604.

Figure 27:
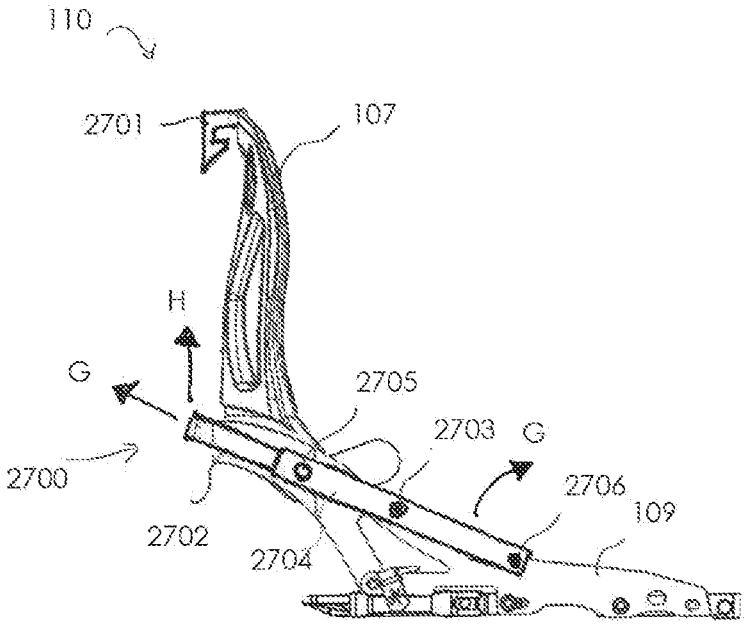
FIG. 27 is a side view of a seventh embodiment of a lateral stiffening device attached to a touring snowboard binding.
Figure 28:
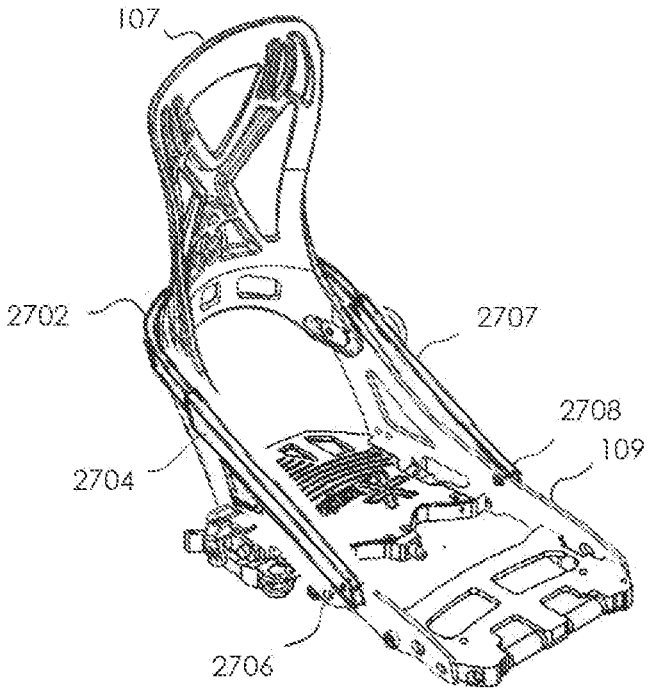
FIG. 28 is an isometric view of a seventh embodiment of a lateral stiffening device.

FIG. 27 is a side view of a seventh embodiment 2700 of a lateral stiffening device attached to a touring snowboard binding. In such an embodiment, the ankle and toe straps have been removed for clarity of description. FIG. 28 is an isometric view of seventh embodiment 2700. Seventh embodiment 2700 of lateral stiffening device is a horseshoe shaped mechanism with first stay 2704, U-shaped stay 2702, and second stay 2707. First stay 2704 is pivotally attached to heelcup 109 at pivot 2706. Second stay 2707 is pivotally attached at pivot 2708. U-shaped stay 2702 telescopically attaches with first stay 2704 and 2708 such that the length of the lateral leverage device can be increase along path "G". To turn lateral leverage device 2700 on U-shaped stay 2702 is extended along path "G" and raised along path "H" to clip into attachment 2701.

Figure 29:
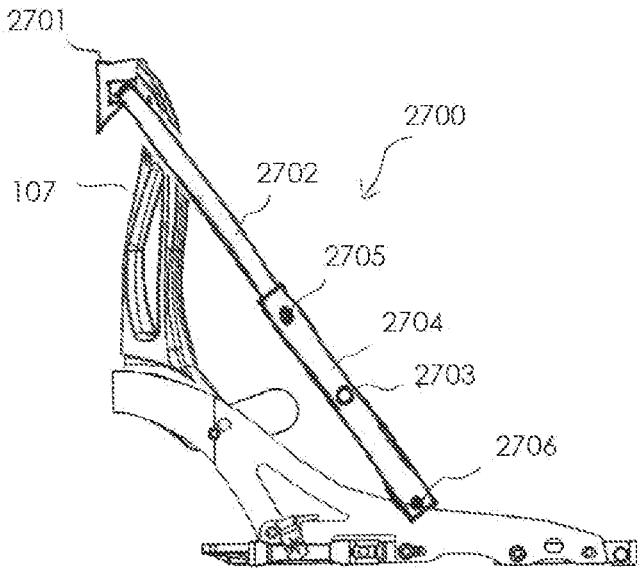
FIG. 29 is a side view of a seventh embodiment of a lateral stiffening device in the on position.
Figure 30:
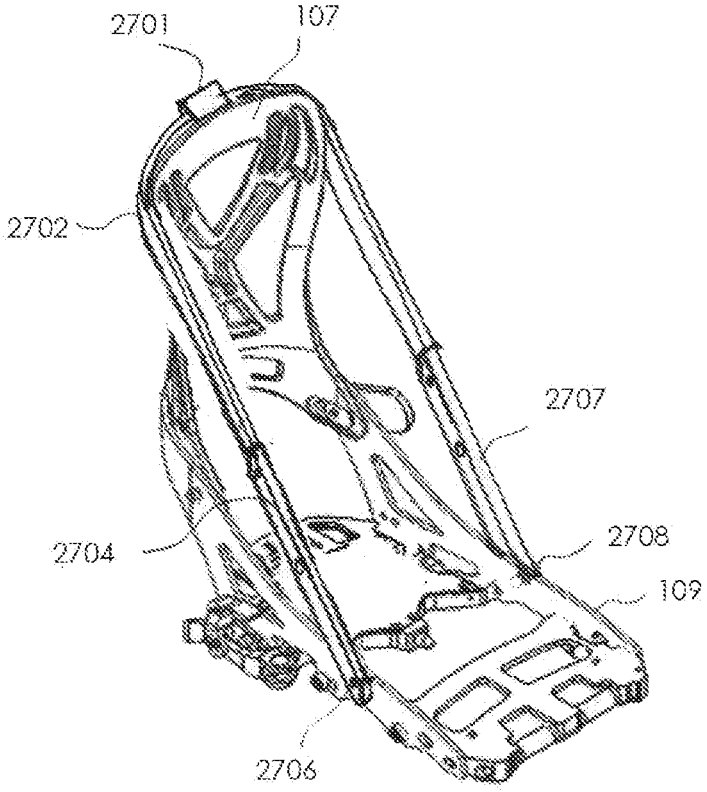
FIG. 30 is an isometric view of a seventh embodiment of a lateral stiffening device in the on position.

FIG. 29 is a side view of lateral stiffening device 2700 in the on position. U-shaped stay 2702 is attached to the top of highback 107 at attachment 2701. FIG. 30 is an isometric view showing the same configuration. When lateral stiffening device 2700 is in the on position, first stay 2702 and second stay 2707 provide lateral support to a snowboard boot (not shown).

Figure 31:
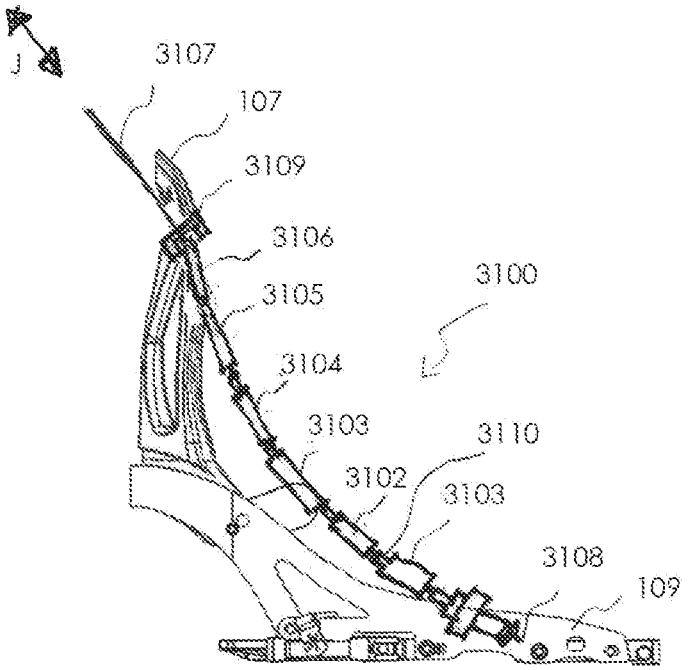
FIG. 31 is an eighth embodiment of a lateral stiffening device.

FIG. 31 is an eighth embodiment 3100 of a lateral stiffening device. In such an embodiment, lateral stiffening device 3100 consists of a tension device 3107 which can be a cord, wire, cable or rope. Tension device 3107 is fixed to heelcup 109 at attachment point 3108 and telescopically attached to highback 107 at attachment 3109. Lateral stiffening device 3100 can also have links 3101 through element 3106 with nipples 3110. FIG. 31 shows lateral stiffening device 3100 in the off position with tensioning device 3107 slack.

Figure 32:
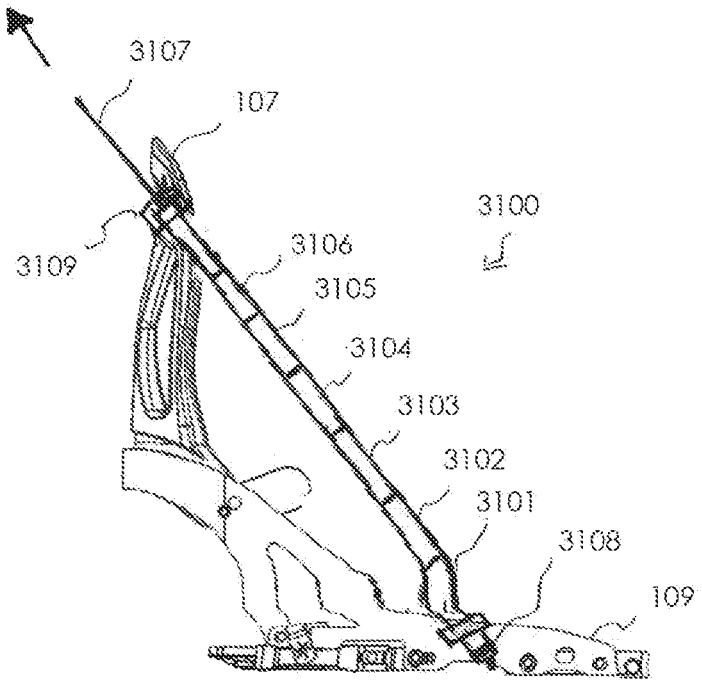
FIG. 32 shows a lateral stiffening device in the on position with a tensioning device taught.

FIG. 32 shows the lateral stiffening device 3100 in the on position with tensioning device 3107 taught. Tensioning device 3107 is pulled out along path "J" through attachment 3109. Attachment 3109 presses down on links 3101 through element 3106 causing nipples 3110 to seat inside links 3101 through element 3106 to create a stiff stay to support a snowboard boot in the lateral direction.

Figure 33:
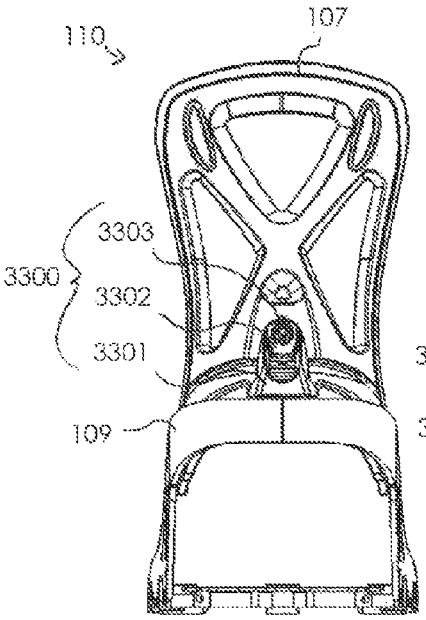
FIG. 33 shows a back view of an adjustable posterior leverage device mounted to touring snowboard bindings.
Figure 34:
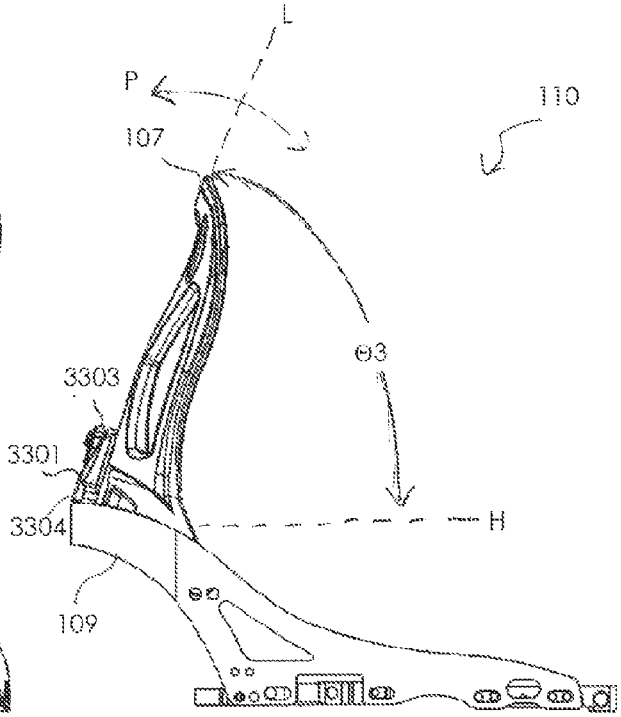
FIG. 34 shows a side view of an adjustable posterior leverage device in the on position.

FIG. 33 shows a back view of an embodiment of an adjustable posterior leverage device 3300 mounted to touring snowboard bindings 110 with highback 107 and heelcup 109. Adjustable posterior leverage device 3300 can have forward lean piece 3301, adjustment piece 3302 and pivot fastener 3303. FIG. 34 shows a side view of an embodiment of an adjustable posterior leverage device 3300 mounted to touring snowboard binding 110 in the ride mode position where angle θ3 between horizontal dashed line "H" and highback plane "L" is at some angle between about 90° and 65°. Highback 107 is held at angle θ3 by adjustable posterior leverage device 3300. The forward lean piece 3301 of adjustable posterior leverage device 3300 pushes against heelcup 109 with base portion 3704 preventing highback 107 from rotating posteriorly along path "P". More detailed views of adjustable posterior leverage device 3300 are shown in FIGS. 37 through 40.

Figure 35:
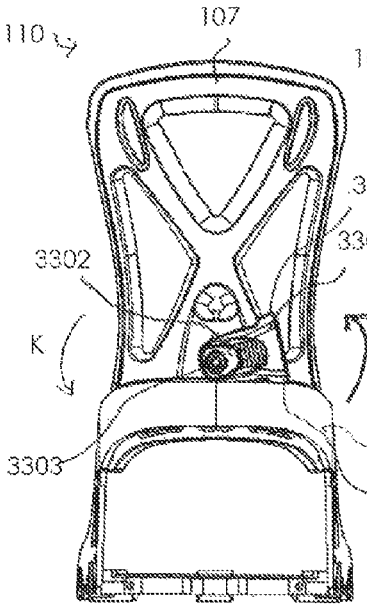
FIG. 35 shows a back view of an adjustable posterior leverage device in the off position.
Figure 36:
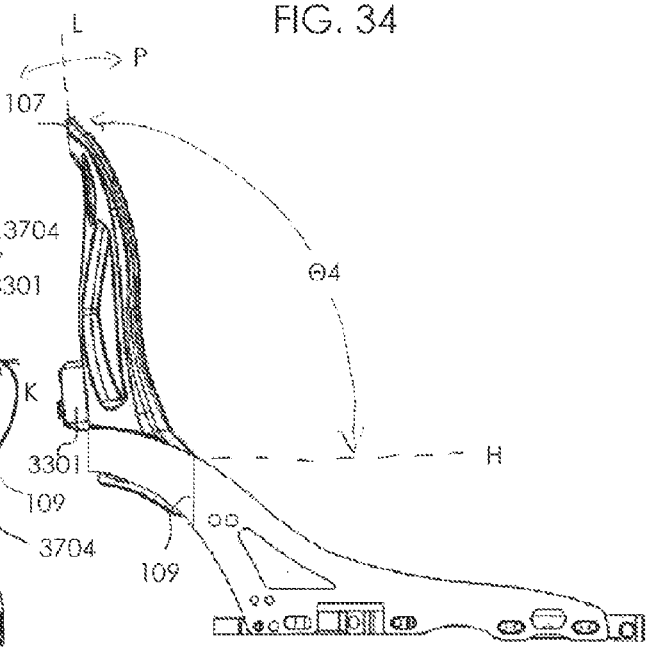
FIG. 36 shows a side view of an adjustable posterior leverage device in the off position.

FIG. 35 shows a back view of an adjustable posterior leverage device 3300 mounted to touring snowboard bindings 110 in the touring position. Adjustable posterior leverage device 3300 is rotated approximately 90° about path "K" such that base portion 3704 is not in contact with heelcup 109. With adjustable posterior leverage device 3300 in the rotated touring position, highback 107 can rotate back along path "P" as shown in FIG. 36. The angle θ4 between horizontal "H" and highback plane "L" in the touring position is generally between about 90° and 100° to allow a user to stride further without posterior support on the back of their snowboard boot.

Figure 37:
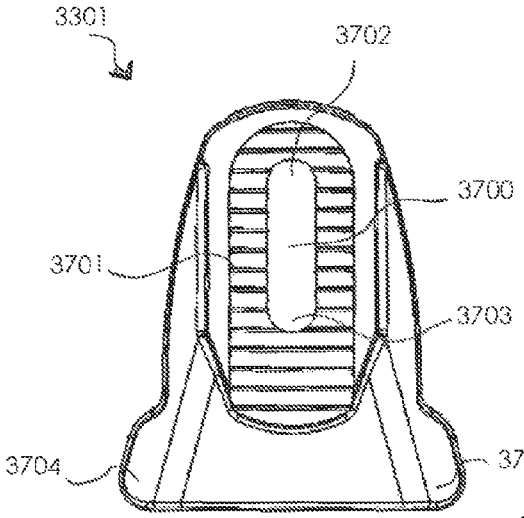
FIG. 37 shows a detailed back view of a forward lean piece of an adjustable posterior leverage device.

FIG. 37 shows a detailed back view of forward lean piece 3301 of adjustable posterior leverage device 3300. Forward lean piece 3301 can have adjustment slot 3700, adjustment grip teeth 3701, maximum forward lean position 3702 and minimum forward lean position 3703. Forward lean piece 3301 can further have base portion 3704 for contacting heelcup 109. Base portion 3704 is generally wide to prevent the forward lean block 3301 from rotating along path "K" as shown in FIG. 35 when posterior load is applied to highback 107.

Figure 38:
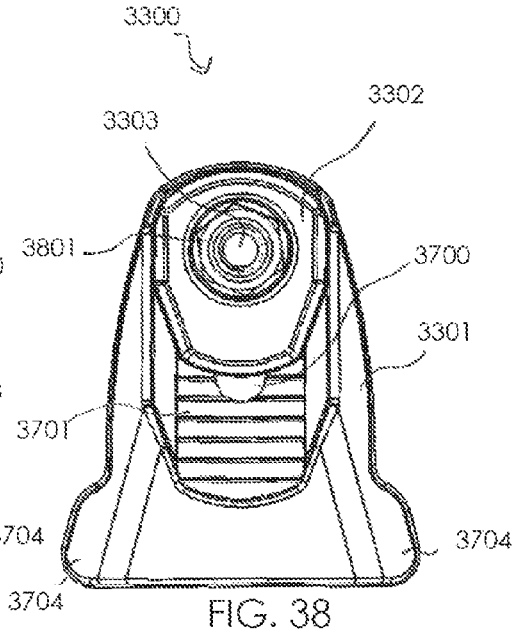
FIG. 38 shows a detailed back view of an adjustable posterior leverage device in the maximum forward lean position.
Figure 39:
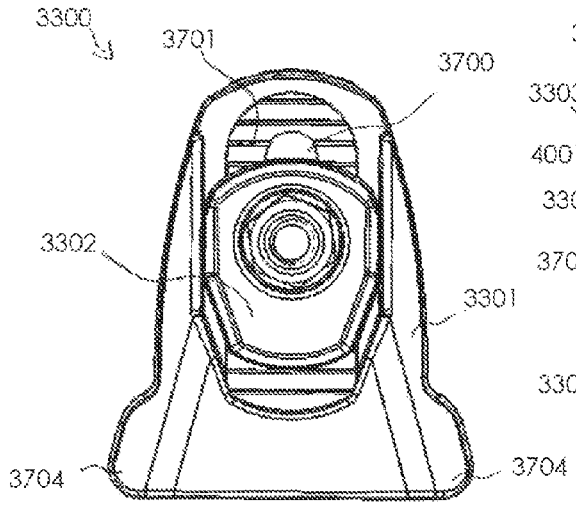
FIG. 39 shows a detailed back view of an adjustable posterior leverage device in the minimum forward lean position.
Figure 40:
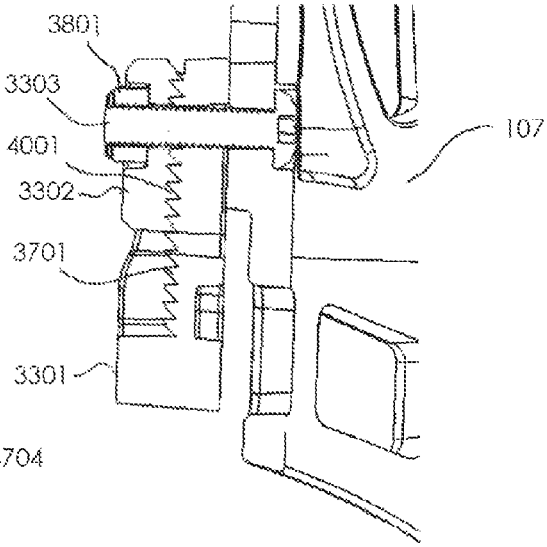
FIG. 40 is a detailed side view of the adjustable posterior leverage device.

FIG. 38 shows a detailed back view of adjustable posterior leverage device 3300 in the maximum forward lean position. In some embodiments, adjustment piece 3302 is positioned such that pivot screw 3303 is positioned at the top of slot 3700 in the maximum forward lean position 3702. When nut 3801 is tightened on adjustment piece 3302 the teeth 3701 on forward lean piece 3301 and the teeth 4001 on adjustment piece 3302 (see FIG. 40) can grip together to prevent pivot screw 3303 from sliding in slot 3700. FIG. 39 shows a detailed back view of adjustable posterior leverage device 3300 in the minimum forward lean position. In the illustrated embodiment, adjustment piece 3302 is positioned such that pivot screw 3303 is positioned at the bottom of slot 3700 in the minimum forward lean position 3703 (see FIG. 37). When nut 3801 is tightened on adjustment piece 3302 the teeth 3701 on forward lean piece 3301 and the teeth 4001 on adjustment piece 3302 can grip together to prevent pivot screw 3303 from sliding in slot 3700. The ride mode forward lean angle θ3 as shown in FIG. 34 can be adjusted generally between about 90° and 65° by moving pivot screw along slot 3700 with adjustment piece 3302. In some embodiments, the incremental adjustment of θ3 is only limited by the tooth size of teeth 4001 and 3701 (e.g., the smaller the teeth the smaller the incremental adjustment angle). The most desirable incremental adjustment angle is around approximately 2°.

Figure 41:
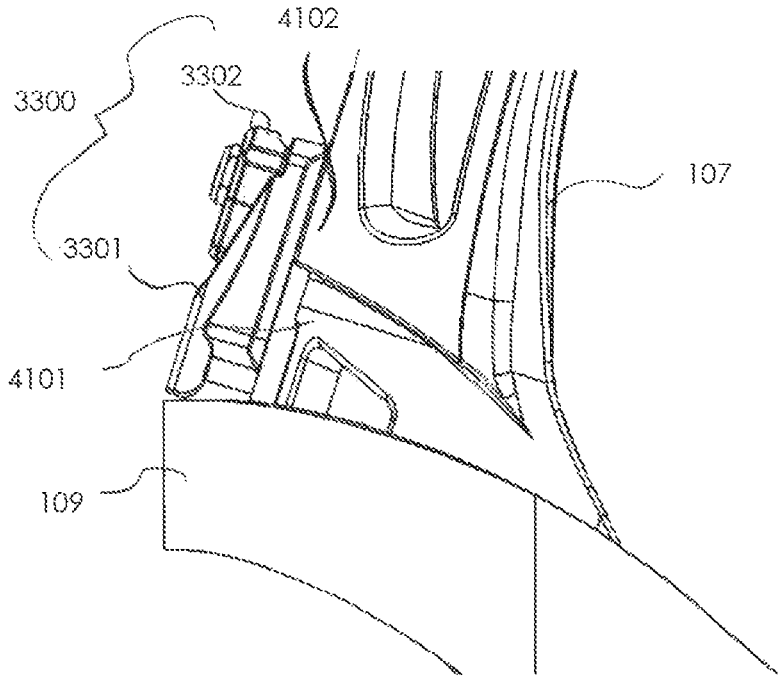
FIGS. 41 and 42 are detailed views of an adjustable posterior leverage device mounted to highback.
Figure 42:
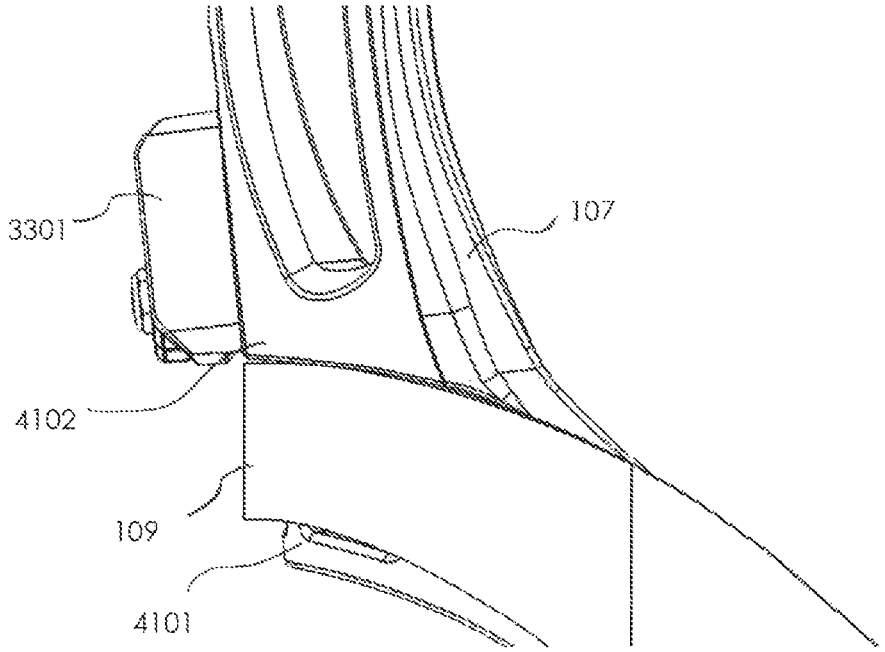

FIGS. 41 and 42 are detailed views of adjustable posterior leverage device 3300 mounted to highback 107. Highback 107 can have a mounting surface 4102 which protrudes from highback bottom 4101 to allow the highback to enter the touring position as shown in FIG. 36. In FIG. 41, mounting surface 4102 allows adjustable posterior leverage device 3300 to achieve ride mode angle θ3 by creating a position such that forward lean piece 3301 can contact heelcup 109. As illustrated in FIG. 42, in some embodiments, highback bottom 4101 allows adjustable posterior leverage device 3300 achieve tour mode angle θ4 by allowing highback 107 to nest into heelcup 109 and recline back past 90° as shown in FIG. 36 when adjustable posterior leverage device 3300 is rotated as shown in FIG. 35.

Advantageously, adjustable posterior leverage device 3300 allows for a unique ability to quickly adjust between a touring position as shown in FIGS. 35 and 36 and a ride mode position as shown in FIGS. 33 and 34 in one simple movement while being able to set the ride mode position angle θ3 generally between about 90° and 65°. Other devices require at a minimum two movements to adjust the forward lean positions.

FIG. 43 is front view of an embodiment of a snowboard boot 4300 with integrated binding features. Snowboard boot 4300 can comprise a boot upper 4302 which can be made of many materials such as plastic, leather, fabric, foam, metal, composite materials, etc. Snowboard boot 4300 can also comprise a boot lower 4301 which can be made of many materials such as plastic, leather, fabric, foam, metal, composite materials, etc. Snowboard boot 4300 can further comprise a highback 107 attached at pivots 4303 and 4304. Snowboard boot 4300 can further comprise lateral leverage device 100. Lateral leverage device 100 can attach at a first attachment point 111 on highback 107 and at second attachment 104 on boot lower 4301. In some embodiments, the lateral leverage device 100 shown in FIG. 43 can be the same as those described with respect to FIGS. 1-32. The function of embodiments of the lateral leverage device 100 is explained above with respect to FIGS. 1-32.

Figure 44:
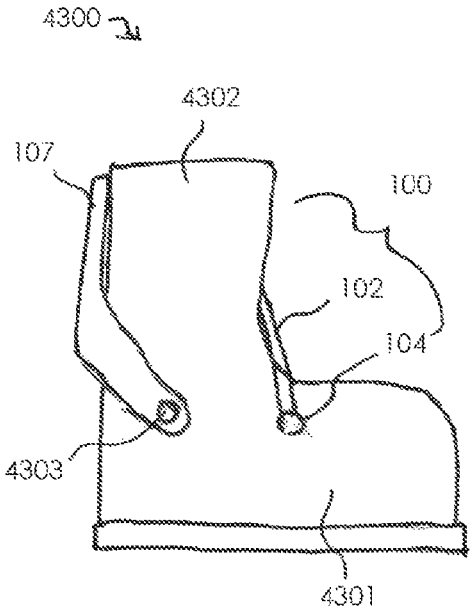
FIG. 44 is a side view of a snowboard boot with integrated binding features.
Figure 45:
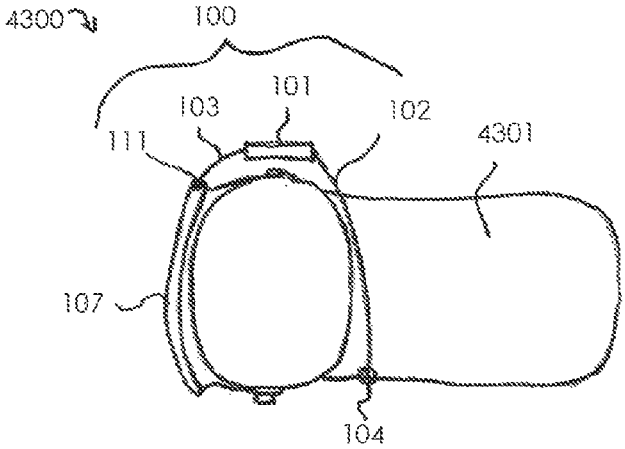
FIG. 45 is a top view of a snowboard boot with integrated binding features.

FIG. 44 is a side view of snowboard boot 4300 with integrated binding features, while FIG. 45 is a top view of snowboard boot 4300 with integrated binding features. In some embodiments, lateral leverage device 100 can be used on both sides of the boot to provide lateral leverage to both sides of the boot 4300. Lateral leverage device is only shown on one side of the boot 4300 in this figure.

Figure 46A:
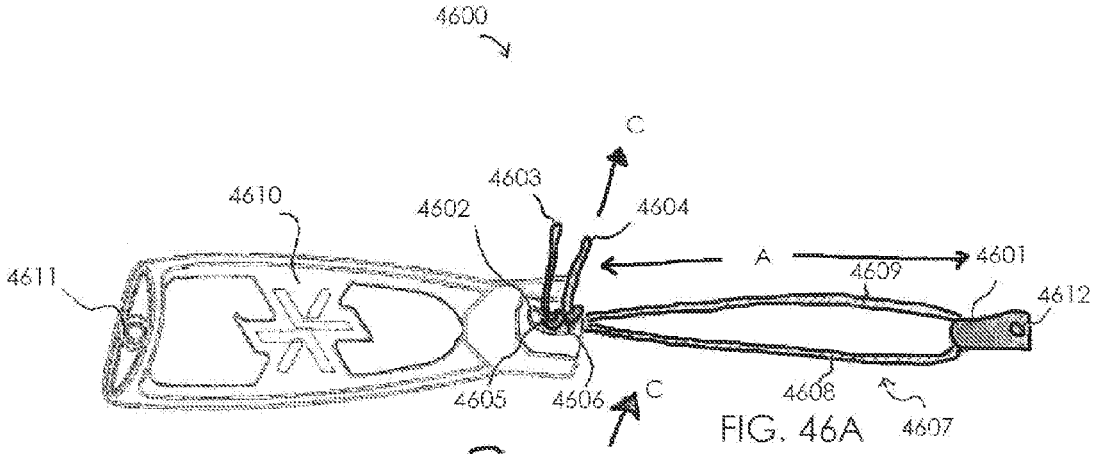
FIG. 46A is a side view of a preferred embodiment of a lateral leverage device.
Figure 46B:
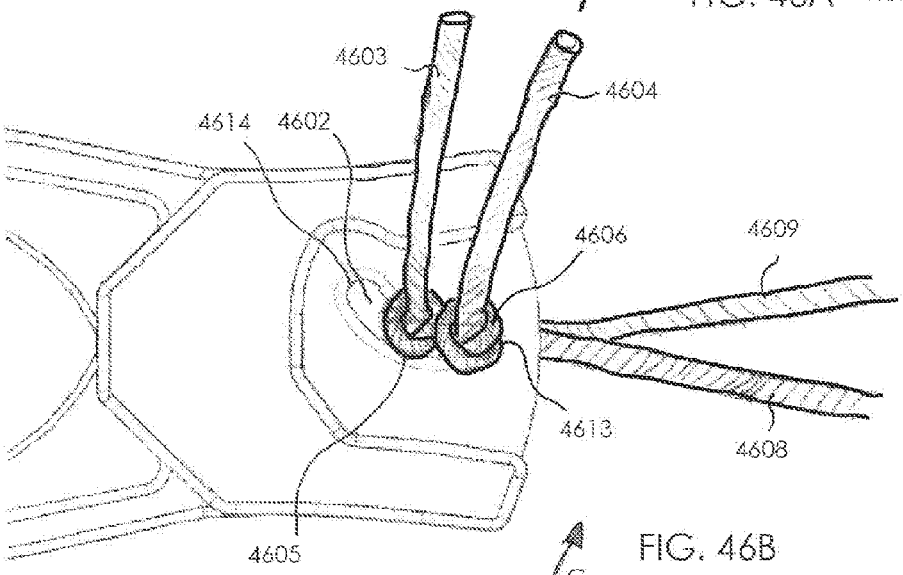
FIG. 46B is a detailed side view of the embodiment of FIG. 46A.
Figure 46C:
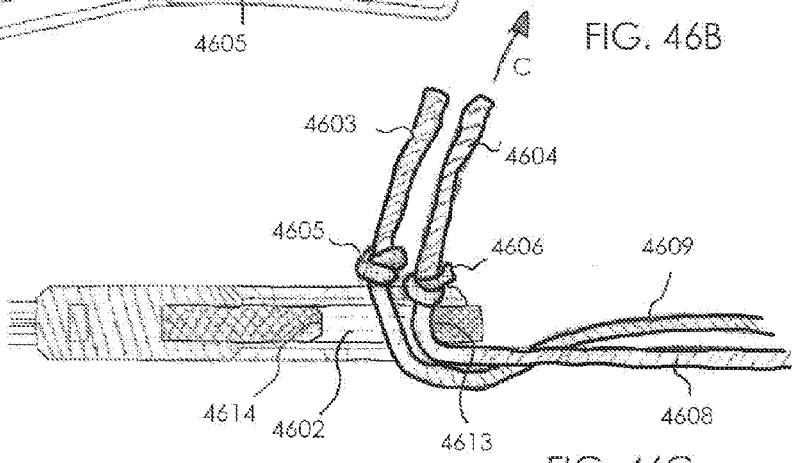
FIG. 46C is a detailed cross-sectional top view of the embodiment of FIG. 46A.

FIGS. 46A-46C illustrate a preferred embodiment 4600 of lateral leverage device 100. FIG. 46 shows a top view of the embodiment 4600 of lateral leverage device 100 in the neutral position with minimum to no tension in the system. Embodiment 4600 can comprise of first attachment 4611 for attaching to the top of the highback (shown as first attachment Ill in FIGS. 1-32), tension element 4610 which can be made of injection-molded plastic, tension cord 4607, and second attachment 4612 (shown as second attachment 104 in FIGS. 1-32). Tension element 4610 can further comprise slot 4602. Tension element 4607 can have first side 4608 with first end 4604 and second side 4609 with second end 4603. First end 4604 is contained in slot 4602 by knot 4606, first side 4608 of tension element 4607 passes through the slot 4602 and then through loop 4601 on second attachment 4612. After tension element 4607 passes through loop 4601 it turns into second side 4609. Second side 4609 passes back through slot 4602. Second end 4603 is contained in slot 4602 by knot 4605.

FIG. 46B is a detailed top view of the embodiment 4600 of lateral leverage device 100, while FIG. 46C is a detailed side view of the embodiment 4600. Pulling up on first end 4604 in direction C increases tension in embodiment 4600 to provide lateral leverage as described, for example, in FIGS. 1-17. As tension is increased distance A is decreased and tension is created in first side 4608 and second side 4609. Knot 4605 crimps into first side 4608 to maintain tension in the system. Pulling on second end 4603 such that knot 4605 travels in slot 4602 to slot end 4614, tension is reduced in the system because knot 4605 is no longer crimping into first side 4608 of tension element 4607.

Touring snowboard boot binding with adjustable leverage devices, and components thereof, disclosed herein and described in more detail above may be manufactured using any of a variety of materials and combinations thereof. In some embodiments, one or more metals, such as, for example, aluminum, stainless steel, steel, brass, titanium, alloys thereof, other similar metals, and/or combinations thereof may be used to manufacture one or more of the components of the splitboard binding apparatus and systems of the present disclosure. In some embodiments, one or more plastics may be used to manufacture one or more components of the splitboard binding apparatus and systems of the present disclosure. In yet further embodiments, carbon-reinforced materials, such as carbon-reinforced plastics, may be used to manufacture one or more components of the splitboard binding apparatus of the present disclosure. In additional embodiments, different components using different materials may be manufactured to achieve desired material characteristics for the different components and the splitboard binding apparatus as a whole.

Some embodiments of the apparatus, systems, and methods disclosed herein may use or employ apparatus, systems, methods, components, or features disclosed in U.S. patent application Ser. No. 12/604,256, which was filed on Oct. 22, 2009 and was published as U.S. Patent Publication No. 2010/0102522 on Apr. 29, 2010, and which is projected to issue as U.S. Pat. No. 8,469,372 on Jun. 25, 2013, entitled "Splitboard Binding Apparatus," the entire content of which is hereby incorporated by reference in its entirety. Some embodiments of the apparatus, systems, and methods disclosed herein may use or employ apparatus, systems, methods, components, or features disclosed in U.S. patent application Ser. No. 13/458,560, which was filed on Apr. 27, 2012 and was published as U.S. Patent Publication No. 2012/0274036 on Nov. 1, 2012, entitled "Splitboard Binding Apparatus and Systems," the entire content of which is hereby incorporated by reference in its entirety. Some embodiments of the apparatus, systems, and methods disclosed herein may use or employ apparatus, systems, methods, components, or features disclosed in U.S. patent application Ser. No. 13/763,453, which was filed on Feb. 8, 2013, entitled "Splitboard Joining Device," the entire content of which is hereby incorporated by reference in its entirety.

Conditional language such as, among others, "can," "could," "might," or "may," unless specifically stated otherwise, are otherwise understood within the context as used in general to convey that certain embodiments include, while other embodiments do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

It should be emphasized that many variations and modifications may be made to the embodiments disclosed herein, the elements of which are to be understood as being among other acceptable examples. Accordingly, it should be understood that various features and aspects of the disclosed embodiments can be combined with or substituted for one another in order to form varying modes of the disclosed apparatus, systems, and methods. All such modifications and variations are intended to be included and fall within the scope of the embodiments disclosed herein.

What is claimed is:

1. A splitboard binding for use on a splitboard and configured to receive a boot, the splitboard binding comprising a highback, an ankle portion, and a lateral leverage device, wherein the lateral leverage device comprises a first attachment portion at or near an upper portion of the highback, a second attachment portion on an opposing side of the binding at or near the ankle portion of the binding, and an adjustable tension element extending between the first attachment portion and the second attachment portion, wherein the splitboard binding is configured for use in a ride mode configuration and in a tour mode configuration, wherein the lateral leverage device is configured to provide lateral support to a boot in the tour mode configuration such that when the tension in the lateral leverage device is increased the lateral support to the boot is increased, and wherein the lateral leverage device is configured to provide lateral support to a boot in the ride mode configuration such that when the tension in the lateral leverage device is decreased the lateral support to the boot is decreased.

2. The binding of claim 1, wherein the second attachment portion of the lateral leverage device is connected to an ankle strap at or near a ratchet, and wherein the lateral leverage device is configured such that when the ratchet is released the lateral leverage device is also released.

3. The binding of claim 1, wherein the lateral leverage device is configured to provide increased ankle support in the tour mode and decreased ankle support in the ride mode.

4. The binding of claim 1, wherein the adjustable tension element extends generally diagonally between the first attachment portion and the second attachment portion of the lateral leverage device.

5. The binding of claim 1, wherein the adjustable tension element extends from a left side of the binding to a right side of the binding.

6. The binding of claim 1, wherein the adjustable tension element extends from a right side of the binding to a left side of the binding.

7. The binding of claim 1, wherein the tension in the lateral leverage device is independent of the leverage angle of the highback.

8. The binding of claim 1, wherein the lateral leverage device is configured to extend across a front portion of a boot.

9. A splitboard comprising the binding of claim 1.

* * * * *